US006973275B2

(12) United States Patent
Sasai

(10) Patent No.: US 6,973,275 B2
(45) Date of Patent: Dec. 6, 2005

(54) IMAGE FORMING DEVICE

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 51 days.

(21) Appl. No.: 10/825,015

(22) Filed: Apr. 15, 2004

(65) Prior Publication Data

US 2004/0264989 A1 Dec. 30, 2004

(30) Foreign Application Priority Data

Jun. 24, 2003 (JP) ..... 2003-179322

(51) Int. Cl.[7] ..... G03G 15/06; G03G 15/16; G03G 15/30

(52) U.S. Cl. ..... 399/55; 399/66; 399/149; 399/354

(58) Field of Search ..... 399/53, 55, 56, 399/66, 149, 150, 343, 352, 353, 354, 357, 399/358, 359, 360

(56) References Cited

U.S. PATENT DOCUMENTS 6,400,918 B1 * 6/2002 Ishii et al. ..... 399/149
6,801,735 B2 * 10/2004 Komiya et al. ..... 399/149

FOREIGN PATENT DOCUMENTS

JP 08-095453 4/1996
JP 10-039705 * 2/1998

* cited by examiner

*Primary Examiner*—Hoang Ngo
(74) *Attorney, Agent, or Firm*—Hogan & Hartson, LLP

(57) ABSTRACT

An image forming device includes an image forming unit that includes a photoconductive drum which carries an electrostatic latent image, a developing roller which forms a developing nip by contacting the photoconductive drum and develops the latent image by using toner, and a transfer roller that forms a transferring nip by contacting the photoconductive drum and transfers a toner image onto a recording paper. A transferring voltage impressing circuit impresses to the transfer roller, a voltage of an opposite polarity to a polarity of a transfer process, for a prescribed period of time during a period when the recording paper is absent in the transferring nip. A developing voltage impressing circuit impresses to the developing roller, a voltage of a same polarity as a developing process and lower than the developing process when a field impressed with the voltage of the opposite polarity by the transferring voltage impressing circuit passes the developing nip.

57 Claims, 13 Drawing Sheets

IMAGE FORMING DEVICE

BACKGROUND OF THE INVENTION

1. Field of the Invention

The present invention relates to an electro-photographic image forming device, and more particularly to an image forming device having a contact-type transfer unit.

2. Description of the Related Art

According to a conventional electro-photographic image forming device, a bias roller made of a material having electrical conductivity or resistance comes in contact with a cleaning roller. During an image forming process, the bias roller is impressed with a voltage having a polarity (negative) that is the same as the polarity of a developed toner. During a period from an end of one image forming process until a start of a next image forming process, the bias roller is impressed with a voltage having a polarity (positive) that is the opposite to that of the developed toner. The toner remaining on a photoconductor is removed satisfactorily.

In the conventional cleaning technology, there are drawbacks that the bias roller and the cleaning roller are provided and the toner remaining on the photoconductive drum after a transfer process cannot be removed sufficiently by these rollers.

SUMMARY OF THE INVENTION

According to an aspect of the present invention, an image forming device includes an image carrier that rotates on its axis, a developing unit that develops an electrostatic latent image on the image carrier, a transfer unit that contacts the image carrier to form a nip part, a transferring voltage impressing circuit and a developing voltage impressing circuit. The transferring voltage impressing circuit is switched off after impressing to the transfer unit, a voltage having a polarity that is opposite to that of the transfer process for a prescribed period of time during one period when a recording paper is absent in the nip part. The developing voltage impressing circuit impresses a voltage to the developing unit when a field of the image carrier impressed with the voltage having the opposite polarity by the transferring voltage impressing circuit passes a field where the developing unit is provided. Further, the voltage impressed by the developing voltage impressing circuit is a voltage having a polarity that is the same as the developing process and lower than the voltage of the developing process.

The image carrier is preferable to stop rotating after making at least one rotation or more after the field located at the transferring nip part when the voltage impressed to the transfer unit is switched off reaches the developing unit.

According to the present invention, the toner remaining on the image carrier can be removed reliably by a simple structure and cleaning efficiency can be improved.

DETAILED DESCRIPTION OF THE PREFERRED EMBODIMENTS

Figure 1:
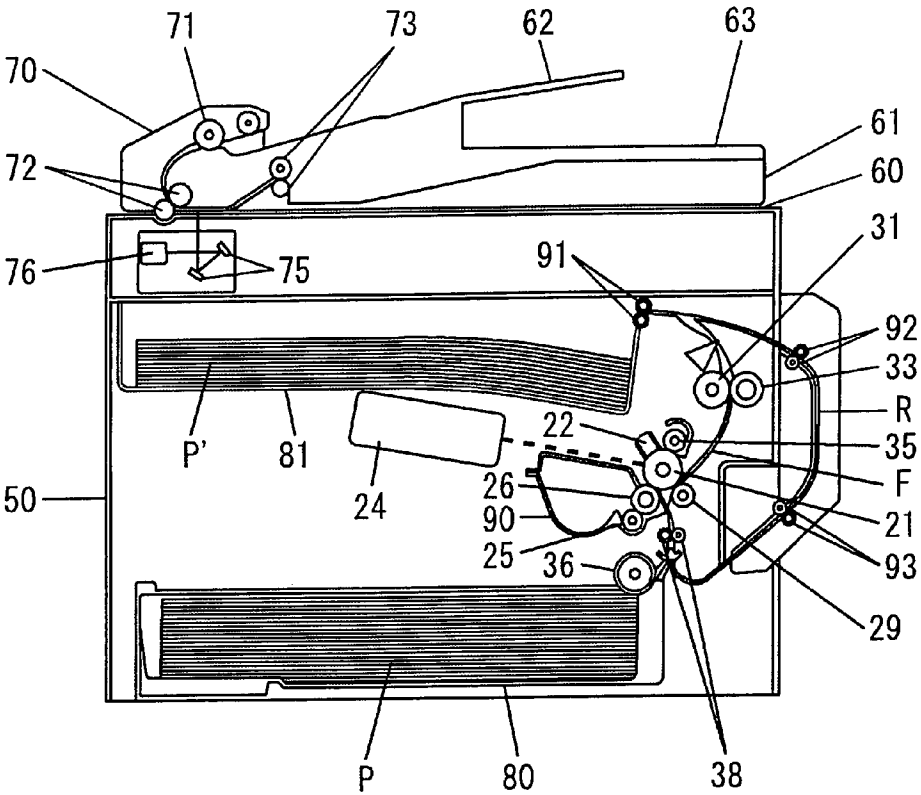
FIG. 1 is a schematic view showing an inner configuration of a facsimile machine according to an embodiment of the present invention.

Embodiments of the present invention will be described in detail. In the following embodiment, a description will be made to a case in which the image forming device of the present invention is a facsimile machine. FIG. 1 is a schematic view showing an inner configuration of the facsimile machine. In FIG. 1, a Flat Bed Scanner (FBS) 60 is provided above a frame 50. The FBS 60 includes a book platen cover 61 which one side is connected by hinges to a position at a rear side of the main frame 50 and which the opposite side is able to be opened and closed. When viewing from the front, an Automatic Document Feeder (ADF) 71 is disposed at the left side of the book platen cover 61. A document supply tray 62 is provided at an upper part of the book platen cover 61 and a document discharge tray 63 is provided below the document supply tray 62. The document supply tray 62 is where original documents to be transported by the ADF 70 are stacked. The document discharge tray 63 is where scanned original documents are discharged.

In the ADF 70, a separate roller 71 is provided in proximity to an exit of the original documents from the document supply tray 62. The separate roller 71 separates the original documents one sheet at a time. A pair of transportation rollers 72 is provided along a document transportation path. A pair of discharge rollers 73 is provided in proximity to an entrance of the original documents into the original discharge tray 63.

A plurality of mirrors 75 and a Charge Coupled Device (CCD) 76 are provided at a scanning position for scanning an image of an original document transported by the ADF 70. The image of the original document is reflected by the mirrors 75 and the image is taken by the CCD 76. Further, a light source (not shown) is also provided for irradiating the original document.

Meanwhile, a paper supply cassette 80 is disposed in a lower part of the main frame 50 in a manner capable of being drawn out in a frontward direction with respect to the front side of the main frame 50. A paper discharge tray 81 is disposed above the paper supply cassette 80. A paper transportation path F is formed from the paper supply cassette 80 to the paper discharge tray 81. The paper transportation path F is a path for carrying out single-side printing on a paper P of the paper supply cassette 80. A reverse transportation path R for duplex printing is provided on the outside of the paper transportation path F. In this facsimile machine, a path from the paper supply cassette 80 at a lower part of the main frame 50 via the paper transportation path F (and the reverse transportation path R) to the paper discharge tray 81 is formed in a shape of letter U facing sideway. A Laser Scan Unit (LSU) 24 and a developer unit 90 are disposed between the paper supply cassette 80 and the paper discharge tray 81, and the space is utilized efficiently.

A photoconductive drum 21 as a photoconductor (image carrier) having a photoconductive film around its outer peripheral surface is disposed at the paper transportation path F. The photoconductive drum 21 is rotated by a main motor 41. A scorotron charger 22 as a charging unit is disposed at a periphery of the photoconductive drum 21. When printing onto a paper, a prescribed charging voltage HVC is impressed to the scorotron charger 22 by a charging voltage impressing circuit 23. The scorotron charger 22 impressed with the charging voltage HVC charges an outer peripheral surface of the photoconductive drum 21 uniformly. In this specification, a state in which the photoconductive drum 21 is charged is a state in which electric charges are held on the surface of the photoconductive drum 21.

The LSU 24 as an exposing unit is provided below the paper discharge tray 81. A polygon mirror is rotated by a polygon motor, and the LSU 24 irradiates a scan laser light on the photoconductive drum according to input image information and forms an electrostatic latent image on the outer peripheral surface of the photoconductive drum.

The developer unit 90 is disposed at the periphery of the photoconductive drum 21. The developer unit 90 includes a toner case that stores positively charged toner, a supply roller 26, a developing roller 26 and a blade 27. The supply roller 25 supplies the toner from the toner case to the developing roller 26 while charging the toner. A prescribed developing voltage HVB is impressed to the supply roller 25 by the developing voltage impressing circuit 28.

A fuser disposed at a paper discharging side of the paper transportation path F includes a heat roller 31 having a heater lamp 31*a* and a press roller 33 or the like. The heat roller 31 is heated by the heater lamp 31*a* and maintains a prescribed temperature during a fixing process. After a toner image is transferred onto a paper by a transfer roller 29, the toner image on the paper is fixed by being heated and pressured by the heat roller 31 and the press roller 33.

A diffusing unit is disposed at the periphery of the photoconductive drum 21. The diffusing unit is a rotating brush 35 that rotates by making contact with the outer periphery of the photoconductive drum 21. The diffusing unit is provided downstream of the transfer roller 29 in the rotational direction of the photoconductive drum 21. The rotating brush 35 scatters the toner image (memory image) remaining along an outline of the image on the outer peripheral surface of the photoconductive drum 21 after the image is transferred, and removes paper dusts or the like. Further, other than the rotating brush 35, a fixed brush that makes contact with the outer peripheral surface of the photoconductive drum 21 within a prescribed width in the rotational direction of the drum 21 can also be used as the diffusing unit.

In case of single-side printing, the papers P of the paper supply cassette 80 are taken out one sheet at a time by a pick-up roller 36 and transported through the paper transportation path F by resist rollers 38. Each of the papers P passes through a contact part (transferring nip part) between the photoconductive drum 21 and the transfer roller 29 and a contact part (fixing nip part) between the heat roller 31 and the press roller 33 in order, and is discharged onto the paper discharge tray 81 by discharge rollers 91 rotated forward by a sub motor 42.

In case of duplex printing, after single-side printing has been completed, while the paper P that passed through the fixing nip part is being sandwiched by the discharge rollers 91, the paper P is introduced into the reverse transportation path R by the discharge rollers 91 rotated backward by the sub motor 42. The paper P is transported towards the paper supply cassette 80 by transportation rollers 92 and 93 of the reverse transportation path R. Then, the paper P is sent back into the paper transportation path F with its sides reversed, and transported towards the transferring nip part by the resist rollers 38. After duplex printing has been completed, the paper P is discharged onto the paper discharge tray 81 by the discharge rollers 91.

Figure 2:
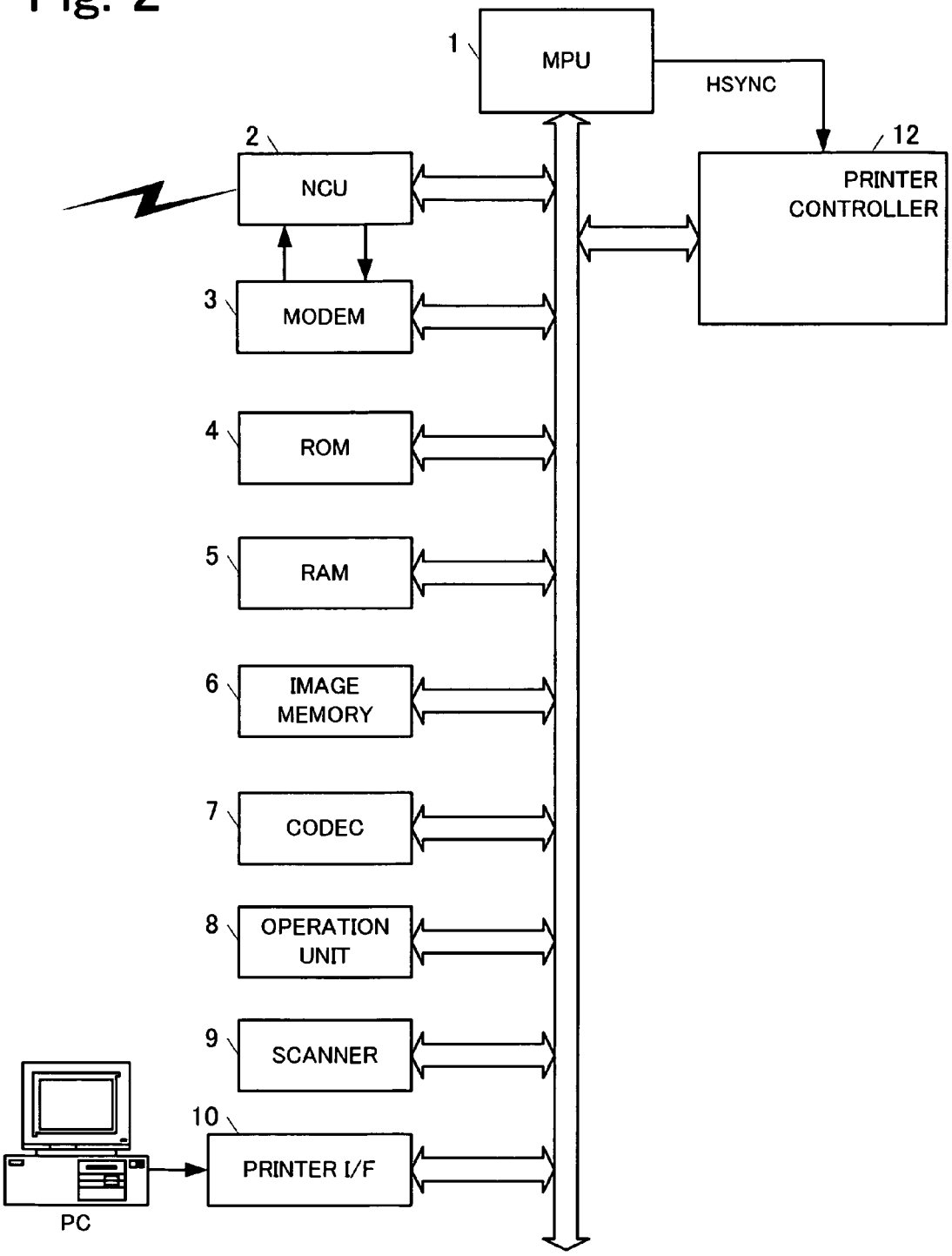
FIG. 2 is a block diagram showing an example of circuitry of the facsimile machine.
Figure 3:
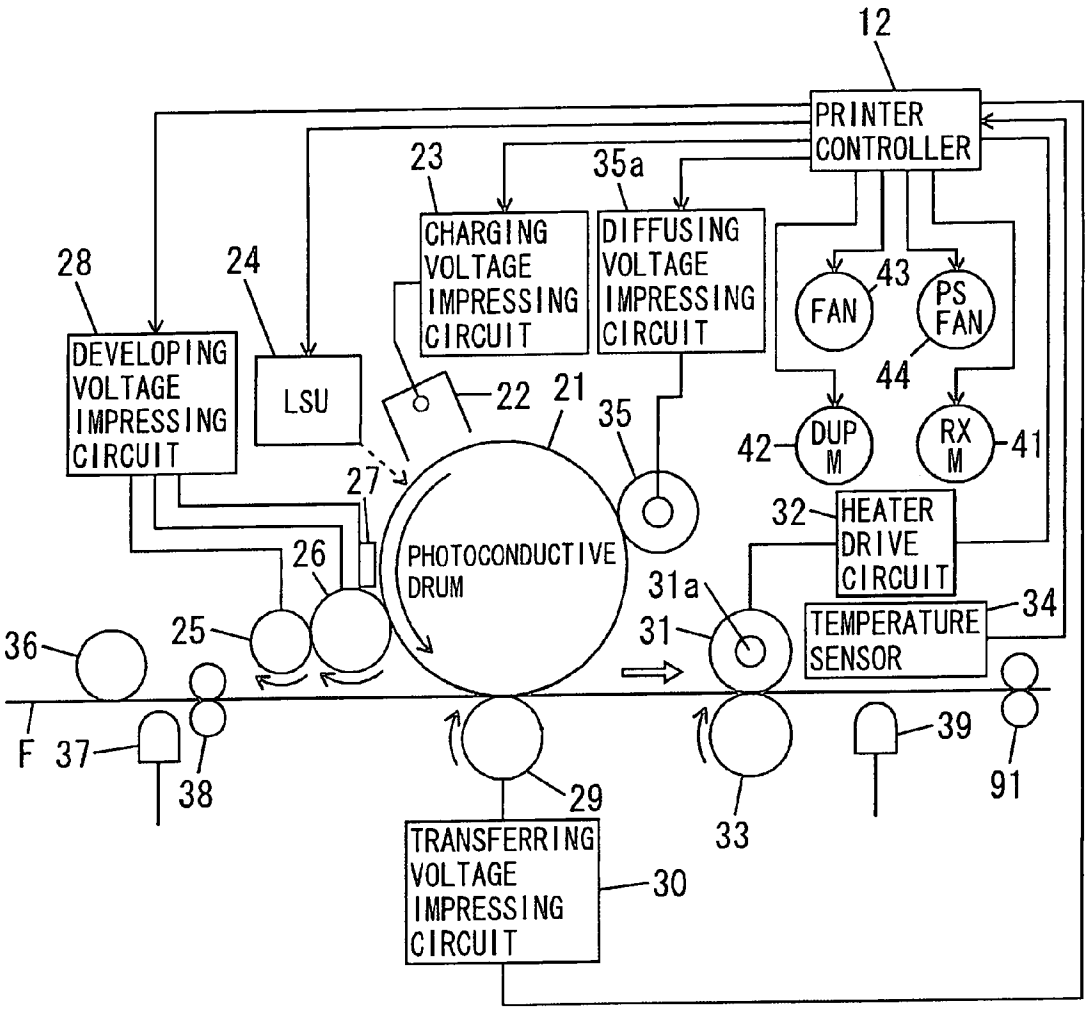
FIG. 3 is a block diagram showing an example of circuitry of a printer unit.

FIGS. 2 and 3 show an overview of the configuration of the circuitry of the facsimile machine. The facsimile machine is formed as a so-called multifunction peripheral having a facsimile function and a copy function. In FIG. 2, the facsimile machine includes a Micro Processing Unit (MPU) (control unit) 1, a Network Control Unit (NCU) 2, a modem 3, a Read Only Memory (ROM) 4, a Random Access Memory (RAM) 5, an image memory (Dynamic RAM (DRAM)) 6, a Coder and Decoder (CODEC) 7, an operation unit 8, a scanner 9 and a printer interface 10. The facsimile machine also includes an electro-photographic printer shown in FIG. 3 and a transportation mechanism that transports the paper P from the paper supply cassette 80 to the transferring nip part and the fixing nip part. The transportation mechanism is as shown in FIG. 1.

The MPU 1 controls each of the units of the facsimile machine. The NCU 2 controls a connection established with a Public Switched Telephone Network (PSTN). The NCU 2 includes a function for transmitting a dial signal according to a telephone number (including a facsimile number) of a destination, and a function for detecting an incoming call. The modem 3 modulates transmission data and demodulates received data in accordance with V.17, V.27ter: v.29, etc. based on a facsimile transmission protocol following the International Telecommunication Union-Telecommunications (ITU-T) Recommendation T.30. Alternatively, the modem 3 modulates and demodulates the transmission data in accordance with V.34 in addition to the above-mentioned facsimile transmission protocols.

The ROM 4 stores programs for controlling the facsimile machine. The RAM 5 temporarily stores data or the like. The image memory 6 temporarily stores received image data or image data scanned by the scanner 9. The CODEC 7 encodes the scanned image for transmission in accordance with Modified Huffman (MH), Modified Read (MR) or Modified Modified Read (MMR) method or the like, and decodes received image data. The operation unit 8 is for a user to instruct a facsimile transmission/reception, printing, etc., or to instruct to start a pre-rotation process. The scanner 9 scans image data of an original document when carrying out a facsimile transmission. The printer interface 10 receives a print command and data from a Personal Computer (PC) and sends the print command and the data to a printer controller 12 of the printer unit to be described later.

FIG. 3 is a schematic diagram showing a configuration of the circuitry of the printer unit of the facsimile machine according to the embodiment of the present invention. Although there are parts that overlap structurally with the above-described mechanism part, a description will be made to the circuitry of the printer unit.

The printer unit includes the photoconductive drum 21 that is rotated by the main motor 41.

The scorotron charger 22 as a charging unit is disposed at the periphery of the photoconductive drum 21. A prescribed positive charging voltage HVC is impressed to the scorotron charger 22 by the charging voltage impressing circuit 23. The outer peripheral surface of the photoconductive drum 21 is charged uniformly at approximately +800V by the scorotron charger 22 impressed with the positive charging voltage HVC. In the present embodiment, as the charging unit, the printer unit includes the scorotron charger 22 that charges the surface of the photoconductive drum 21 without making contact with the photoconductive drum 21. However, instead of the scorotron charger 22, the charging unit may by a charging brush or a charging roller such as a sponge roller or a solid roller that charges the surface of the photoconductive drum 21 by making contact with the photoconductive drum 21.

The LSU 24 as an exposing unit is disposed downstream of the scorotron charger 22 at the periphery of the photoconductive drum 21. In the LSU 24, after image information is input, the polygon mirror that is rotated by the polygon motor scatters the scan laser light output by a laser emitting source in response to the input. Accordingly, an electrostatic latent image corresponding to the image information is formed on the outer peripheral surface of the photoconductive drum 21.

The developer provided downstream of the LSU 24 at the periphery of the photoconductive drum 21 includes the supply roller 25, the developing roller 26 and the blade 27. From the toner case that stores the positively charged toner, the supply roller 25 supplies the toner to the developing roller 26 while charging the toner. A prescribed supply voltage (between +300V and +700V) is impressed to the supply roller 25 by the developing voltage impressing circuit 28. Further, the developing roller 26 forms a developing nip part with the photoconductive drum 21 by making contact with the supply roller 25 and the photoconductive drum 21. A prescribed developing voltage (between +300V and +700V, preferably approximately +400V) is impressed to the developing roller 26 by the developing voltage impressing circuit 28.

The blade 27 contacts elastically with the outer peripheral surface of the developing roller 26 and evens a thickness of the toner layer adhered on the outer peripheral surface of the developing roller 26. A prescribed bias voltage (between +300V and +700V) is impressed to the blade 27 by the developing voltage impressing circuit 28.

The transfer roller 29 as the transfer unit provided downstream of the developer at the periphery of the photoconductive drum 21 is provided across the paper transportation path F to form a nip part with the outer peripheral surface of the photoconductive drum 21. The transfer roller 29 is rotated by the main motor 41. A transferring voltage HVT is impressed to the transfer roller 29 by a transferring voltage impressing circuit 30.

The fuser provided to the paper discharging instead of the transferring nip part of the paper transportation path F is formed with the heat roller 31 having the heater lamp 31*a* and the press roller 33 or the like. The heater lamp 31*a* of the heat roller 31 is heated by the heater drive circuit 32 so that the outer peripheral surface of the heat roller 31 reaches a prescribed temperature. A surface temperature of the heat roller 31 is detected by a temperature sensor 34, e.g., a contact thermistor. The heat roller 31 and the press roller 33 fix the toner image onto a paper by heating and pressuring the paper on which the transfer process has been executed.

A brush 35 that rotates on its axis is provided between the scorotron charger 22 and the transfer roller 29 along the periphery of the photoconductive drum 21. A prescribed diffusing voltage HVCL is impressed to the rotating brush 35 by a diffusing voltage impressing circuit 35*a*.

A pick-up roller 36, a Paper Supply Sensor (PSS) 37, the resist rollers 38, a Paper Discharge Sensor (PDS) 39 and the discharge rollers 91 are provided along the paper transportation path F. The PSS 37 is a sensor that detects paper picked up from the paper supply cassette 80. The PDS 39 is a sensor that detects transported paper which has been recorded on by the transfer process and the fixing process. Other than the main motor 41, the printer unit also includes a sub motor 42 for rotating the discharge rollers 91 forward or backward, an air intake fan 44 for taking air into the main frame 50 and an exhaust fan 43 for exhausting the air.

Figure 4:
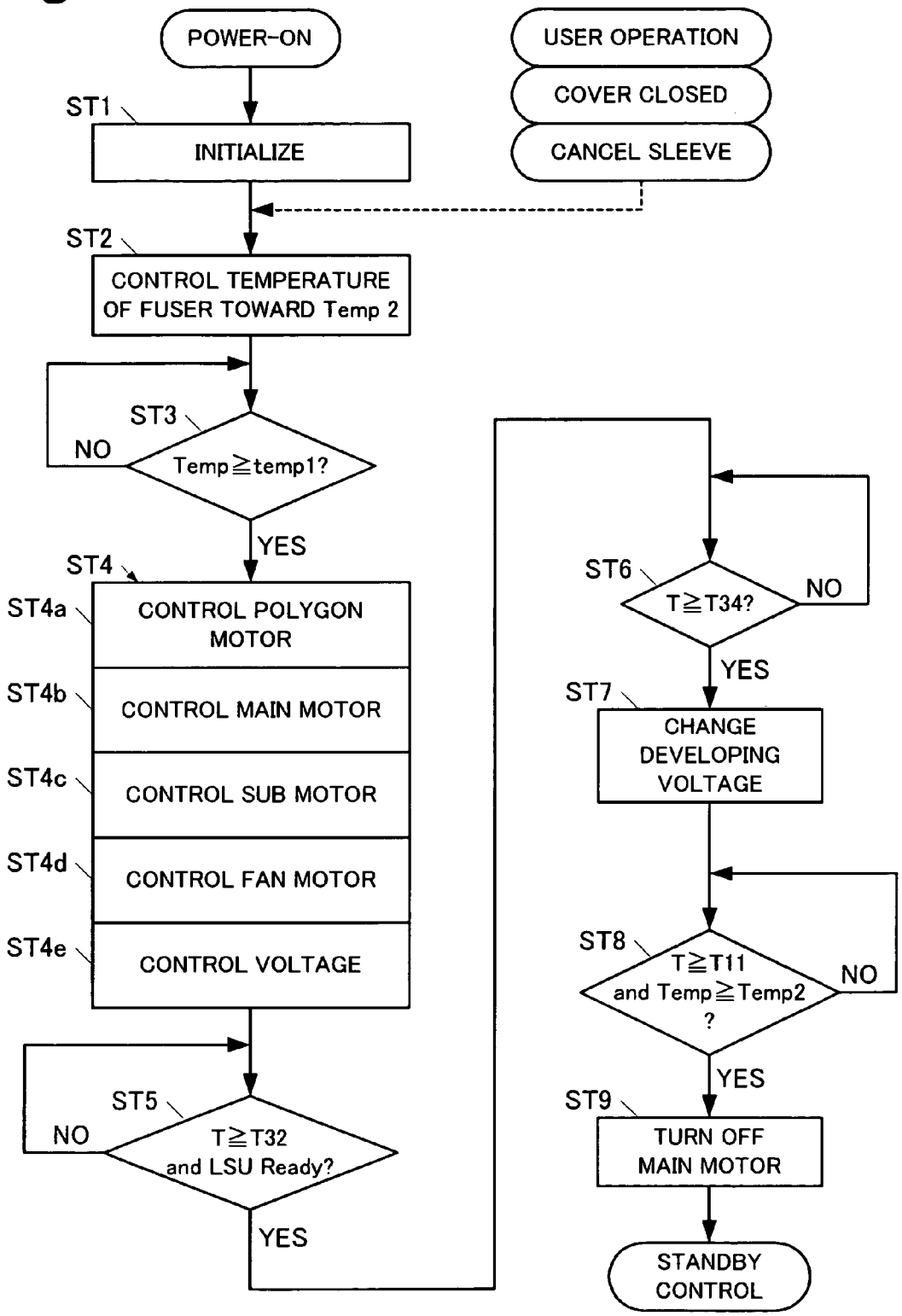
FIG. 4 is a flowchart showing an operation carried out during a warming-up process.

Next, a description will be made of the entire processing operation carried out by the printer unit according to the embodiment of the present invention. First, referring to the flowchart of FIG. 4 and the time chart of FIG. 5, a description will be made to a warming-up process carried out after the power is switched on and until the main motor 41 stops.

When the power is switched on at time t0, at step ST1, an initializing process is executed. At step ST2, the heater drive circuit 32 starts energization to the heater lamp 31*a*, and a control starts to raise the temperature of the fuser detected by the temperature sensor 34 towards a warming-up ending temperature Temp2 (for example, 150° C.). At step ST3, a determination is made as to whether or not the temperature of the fuser has reached a motor rotation starting temperature Temp1 (for example, 105° C.). When the temperature of the fuser reaches Temp1 (time t1), a pre-rotation process is executed at step ST4.

Next, a description will be made to the pre-rotation process. At time t1, the polygon motor of the LSU 24 is turned on and the polygon mirror is rotated (step ST4*a*). At the same time, the main motor 41 is turned on, and each of the photoconductive drum 21, the transfer roller 29, the developing roller 26, the supply roller 25 and the rotating brush 35, respectively, starts rotating, and a timer T11 (main motor pre-rotation timer) starts (step ST4*b*).

At time t1, a control of the sub motor 42 also starts (step ST4*c*). The control of the sub motor 42 is carried out for discharging a remaining amount of paper nipped by each of the rollers 91–93 to the outside of the machine or for detecting the remaining amount of paper by the PSS 37.

At time t1, a timer T101*a* starts. After an elapse of the timer T101*a*, during an effective period of a timer T101*b*, a positive voltage is impressed to the sub motor 42 and each of the rollers 91–93 rotates in a paper discharging direction. Then, during an effective period of a timer T103, the sub motor 42 is turned off Next, during an effective period of a timer T102, a negative voltage is impressed to the sub motor 42 and each of the rollers 91–93 rotates in a reverse transportation direction. Then, the energization to the sub motor 42 stops.

By controlling the sub motor in the above-described manner, when there is a paper nipped by each of the rollers 91–93, the paper is transported and discharged to the outside of the machine or the paper is detected by the PSS 37. Therefore, the effective periods of the timers T101*b* and T102 are recognized as a period of time sufficient for detecting the remaining amount of paper or a period of time necessary for detecting the remaining amount of paper.

Furthermore, as a feature of the sub motor control, in response to the start of the driving of the main motor 41 as a trigger, the timer T101*a* starts and a voltage is impressed to the sub motor 42. That is, since the main motor 41 and the sub motor 42 do not start to drive at the same time, noise and vibrations resulting from resonance of the motors 41 and 42 can be suppressed.

At time t1, control of the fan starts (step ST4*d*). When the temperature of the fuser reaches Tempf1, the exhaust fan 43 starts to drive for discharging warm air near the fuser to the outside of the machine. When the temperature of the fuser reaches Tempf2, the air intake fan 44 starts to drive for taking outside air into proximity of the power source unit. In the present embodiment, Tempf1 and Tempf2 are set at the same temperature, but can be set at different temperatures.

Furthermore, at step ST4, a control of various voltages for the cleaning sequence starts (step ST4*e*). As the voltage control carried out at this point of time, when the temperature of the fuser reaches Temp1, the charging voltage impressing circuit 23 impresses a positive voltage as the charging voltage HVC to the scorotron charger 22. The surface of the photoconductive drum 21 is charged uniformly by this process. That is, uniform electric charges are carried on the surface of the photoconductive drum 21.

A timer T31 starts at time t1 when the rotation of the main motor 41 starts. When the timer T31 expires, the developing voltage impressing circuit 28 impresses a step voltage (for example, approximately +10V) as a developing voltage HVB to the developing roller 26. The step voltage is the same voltage (positive) and weaker than the developing voltage (for example, approximately +400V), when carrying out the image forming process. As described above, by impressing a lower voltage to the developing roller 26, a difference in the electric potential between the surface of the photoconductive drum 21 and the surface of the developing roller 26 becomes large. As a result, there is an improvement in the efficiency of the toner collecting process that moves the toner remaining on the surface of the photoconductive drum 21 to the developing roller 26.

The timer T31 is set at a time required for the photoconductive drum 21 to reach the developing nip part from the position where the scorotron charger 22 is located. That is, while the uncharged part of the photoconductive drum 21 is passing the developing nip part, the developing voltage HVB is not impressed to the developing roller 26. Therefore, the charged toner that is prone to have an adverse effect on the next developing process is not collected.

A timer T41 also starts at time t1. At an expiration of the timer T41, a field of the photoconductive drum 21 that has been charged at time t1 reaches the transferring nip part. At this time, as a transferring voltage HVT, a positive transferring voltage (for example, approximately +1000V) of a polarity that is the opposite to that of the transferring voltage (negative) impressed to the transfer roller 29 at the transfer process of the toner image is impressed.

This process is carried out during an effective period of a timer T42 for returning the remaining toner adhered on the transfer roller 29 back to the photoconductive drum 21. The timer T42 is set at a time longer than the time required for the transfer roller 29 to make one rotation. Therefore, the toner remaining on the entire periphery of the transfer roller 29 is returned to the photoconductive drum 21. At an expiration of the timer T42, the transferring voltage HVT is switched off (not impressed) for an effective period of a timer T48.

At an expiration of the timer T48, the transfer roller 29 is impressed with a transferring voltage (for example, approximately −600V) of a polarity that is the same as that of the transferring voltage (negative) at the transfer process and that is sufficiently strong for charging the surface of the photoconductive drum 21. By this process, the reversely charged remaining toner adhered on the transfer roller 29 at the transferring nip part returns to the photoconductive drum 21. In addition, when the charged field moves to the contact part of the photoconductive drum 21 and the rotating brush 35, at the contact part, the toner trapped in the rotating brush 35 returns to the photoconductive drum 21.

This process is executed during an effective period of a timer T43. Then, the transferring voltage HVT is switched off. The timer T43 is set a time longer than the time required for the transfer roller 29 to make one rotation and shorter than the time required for the photoconductive drum 21 to make one rotation. Therefore, the reversely charged toner remaining on the entire periphery of the transfer roller 29 can be returned to the photoconductive drum 21. In addition, the reversely charged toner on the photoconductive drum 21 that was not collected by the developer is not returned to the transfer roller 29 again. To prevent the reversely charged toner from adhering again to the transfer roller 29, after the timer T43 expires, a voltage (negative) of a polarity that is the same as the polarity of the voltage of the transfer process can be impressed.

A timer T61 starts after starting the rotation of the main motor 41. At the expiration of the timer T61, the field located at the transferring nip part at time t1 reaches the contact part of the photoconductive drum 21 and the rotating brush 35. At this time, a positive diffusing voltage HVCL is impressed to the rotating brush 35 as in the printing process, and adherence of the toner remaining on the photoconductive drum 21 is weakened. To accomplish the weakening of the adherence of the remaining toner, regardless of the charging polarity of the toner, the polarity of the diffusing voltage HVCL can be either positive or negative.

At step ST5, a determination is made as to whether or not conditions (1) and (2) are satisfied at the same time. Condition (1) is that a timer T32 has expired. Condition (2) is that a Ready signal is output from the LSU 24.

To describe in detail, the LSU 24 outputs the Ready signal when the rotation of the polygon motor is stabilized at a prescribed rotation speed. The image forming device of the present embodiment starts a timer T34 after the Ready signal is output. At an expiration of the timer T34, the developing voltage impressing circuit 28 impresses a positive strong voltage (for example, +400V) to the developing roller 26.

Therefore, in case a period of time from when the rotation of the polygon motor starts until when the rotation has stabilized is short, a strong voltage is impressed to the developing roller 26 before the process carried out during the period of the timer T42 has been completed. In other words, a strong voltage is impressed before the process for returning the toner remaining on the surface of the transfer roller 29 back to the drum 21 has been completed for the entire periphery of the transfer roller 29. As a result, a failure is generated that the efficiency in which the toner is collected has decreased. To prevent such a failure, the timer T32 that expires after the timer T42 expires is provided. Further, when the Ready signal is output before the timer T32 expires, the process carried out during the effective period of the timer T43 can be omitted. Moreover, when the Ready signal is not output within a predetermined period, the cleaning sequence stops. In other words, the charging voltage HVC, the developing voltage HVB and the diffusing voltage HVCL are switched off.

When conditions (1) and (2) are satisfied, the process proceeds to step ST6 and the timer T34 starts. At step ST6, a determination is made as to whether or not the timer T34 has expired. When the timer T34 has expired, the process proceeds to step ST7 and the developing voltage impressing circuit 28 impresses a positive strong voltage to the developing roller 26.

Next, the process proceeds to step ST8 and a determination is made as to whether or not conditions (3) and (4) are satisfied at the same time. Condition (3) is that the timer T11 has expired. Condition (4) is that the temperature of the fuser has reached Temp2.

In the image forming device of the present embodiment, when the temperature of the fuser reaches Temp2, the control mode of the heater drive circuit 32 is switched to a mode for maintaining the temperature of the fuser at Temp2, in other words, a standby mode, and the energization to the main motor 41 stops (step ST9). In addition, the control of the various voltages stops and the pre-rotation process (process carried out between time t1 and time t2) ends. However, when the gradient of an increase in the temperature of the fuser is steep and the period of time required until the temperature of the fuser reaches Temp2 is short, a failure is generated that the sub motor control has not been completed. To prevent such a failure, the timer T11 that expires after the time when the sub motor control has been completed (time when the timer T102 expires) is provided.

In addition, by providing the timer T11, since the driving of the main motor 41 and the sub motor 42 do not stop at the same time, the possibility of the motors 41 and 42 renouncing becomes low and noise can be suppressed.

Furthermore, in the image forming device of the present embodiment, the pre-rotation process is carried out after the power is switched on, and also after an exterior cover of the device has been closed, after the sleep state has been cancelled, or when an instruction for starting the pre-rotation process is input from the operation unit 8 by the user. Therefore, when the exterior cover is closed after jammed paper has been removed or when the image forming device has been left for a long period of time without operating, or when the transfer roller 29 has not been cleaned sufficiently, the cleaning of the transfer roller 29 and the photoconductive drum 21 and the process for detecting jammed paper can be carried out reliably.

As described above, there are other effects of carrying out the pre-rotation process by the instruction from the user. When the contact-type charging brush or roller is used as the charger instead of the scorotron charger, there are cases in which the brush or the roller is deformed at the charging nip part if the image forming device is left without being driven for a long period of time. The inventor of the present invention has confirmed that this deformation can be recovered by rotating the brush or the roller several times. However, if the printing operation is carried out for such a purpose, there are inconveniences that the paper and the toner are consumed wastefully. However, by carrying out the pre-rotation process by the instruction from the user as described above, without consuming the paper and the toner, only the brush or the roller can be rotated and the deformation can be solved.

Figure 5:
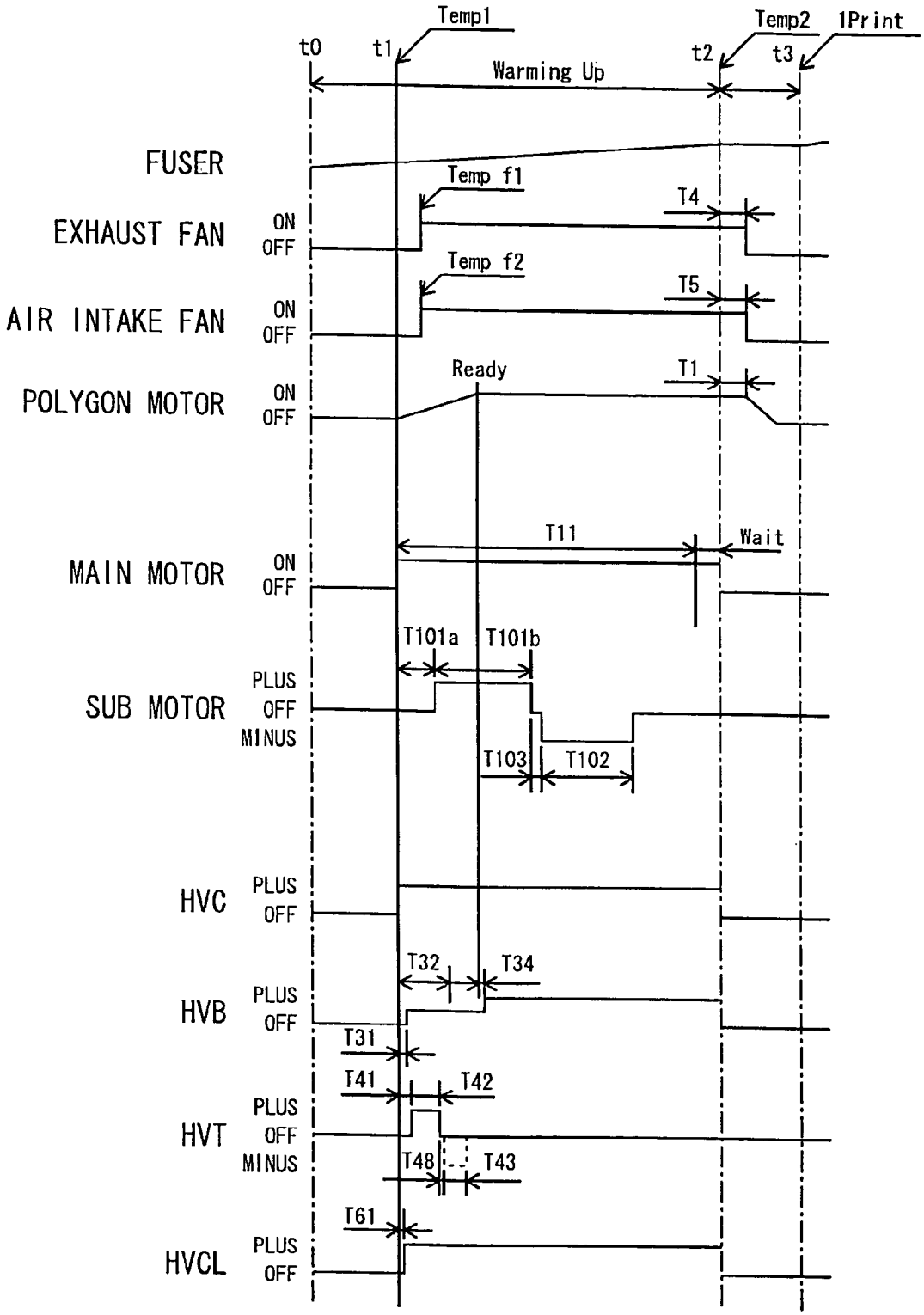
FIG. 5 is a time chart showing waveforms of each unit during the warming-up process.
Figure 6:
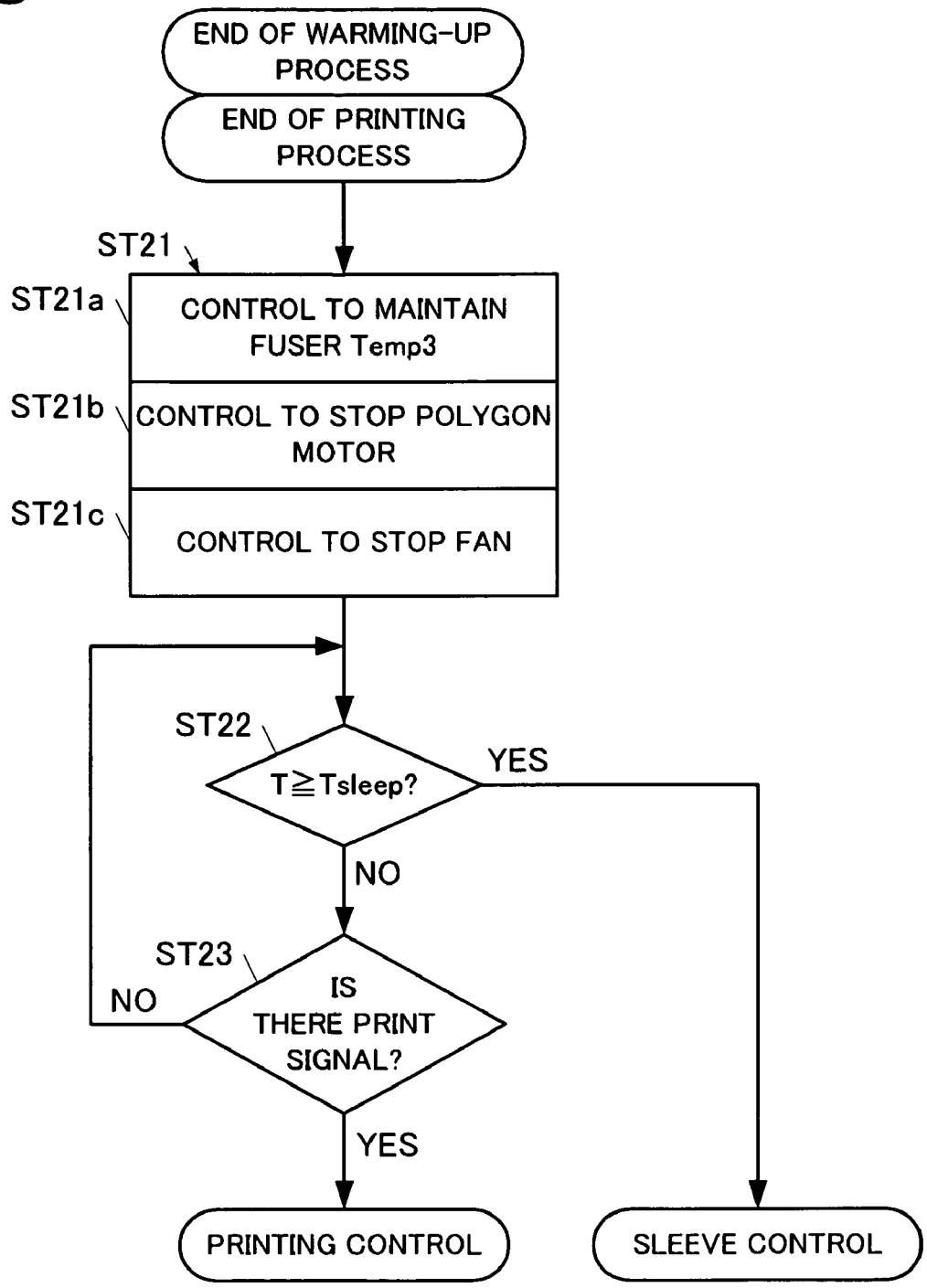
FIG. 6 is a flowchart showing an operation carried out during a standby process.

Next, referring to the time chart of FIG. 5 and the flowchart of FIG. 6, the standby mode control will be described. When the pre-rotation process, in other words, the warming up process is completed at time t2, the control mode is switched to the standby mode. At step ST21*a*, the energization control to the heater lamp 31*a* starts so that the heater drive circuit 32 maintains the temperature of the fuser at Temp3 (standby temperature=150° C.).

At step ST21*b*, a control to stop the polygon motor starts. That is, a timer T1 (polygon stop timer) starts at the stop time t2 of the main motor 41, and when the timer T1 expires, a stop sequence of the polygon motor starts. Further, the timer T1 can be set at any time by a manual operation from the operation unit 8.

That is, after transferring into the standby mode control, the polygon motor is maintained at a constant rotation speed for only the effective period of the timer T1. The reason is that when there is a print request during this period (T1), it becomes unnecessary to carry out a sequence for raising the rotation speed of the polygon motor, and as a result, a period of time required until the print job has been completed can be shortened. That is, when many print jobs are pooled, print requests are made under a state in which there is almost no waiting time between jobs, but by carrying out the above-described stop control, it becomes unnecessary to carry out a sequence for raising the rotation speed of the polygon motor for each job.

Figure 12:
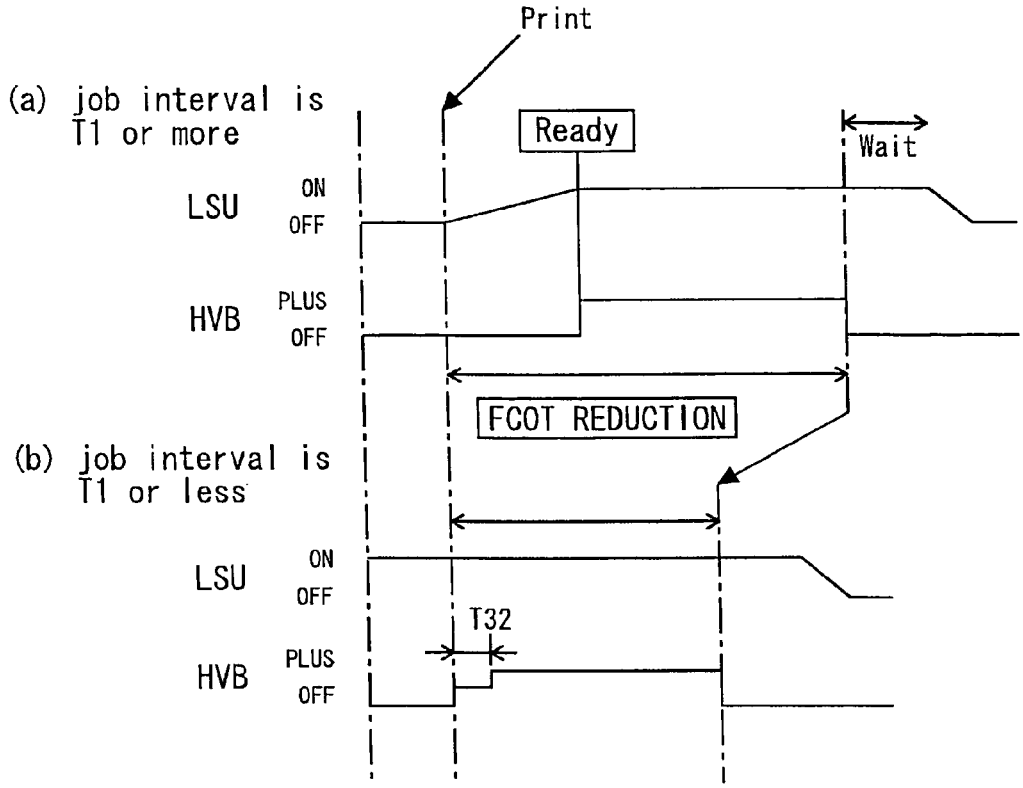
FIG. 12 shows waveforms for describing First Copy Output Time (FCOT) reduction by driving a polygon motor.

This effect will be described with reference to FIG. 12. As shown in FIG. 12(*a*), when a job interval (time from an end of a previous job until a start of a next job) is T1 or more, the polygon motor is turned off after an elapse of T1 from when the main motor 41 is turned off. However, as shown in FIG. 12(*b*), when the job interval is T1 or less, if there is a print request, since the polygon motor is already rotating at a prescribed speed, a positive strong voltage can be impressed immediately as the developing bias HVB at the expiration of the timer T32 without taking time until the rotation of the polygon motor has been stabilized. Therefore, a First Copy Output Time (FCOT) can be reduced.

Figure 13:
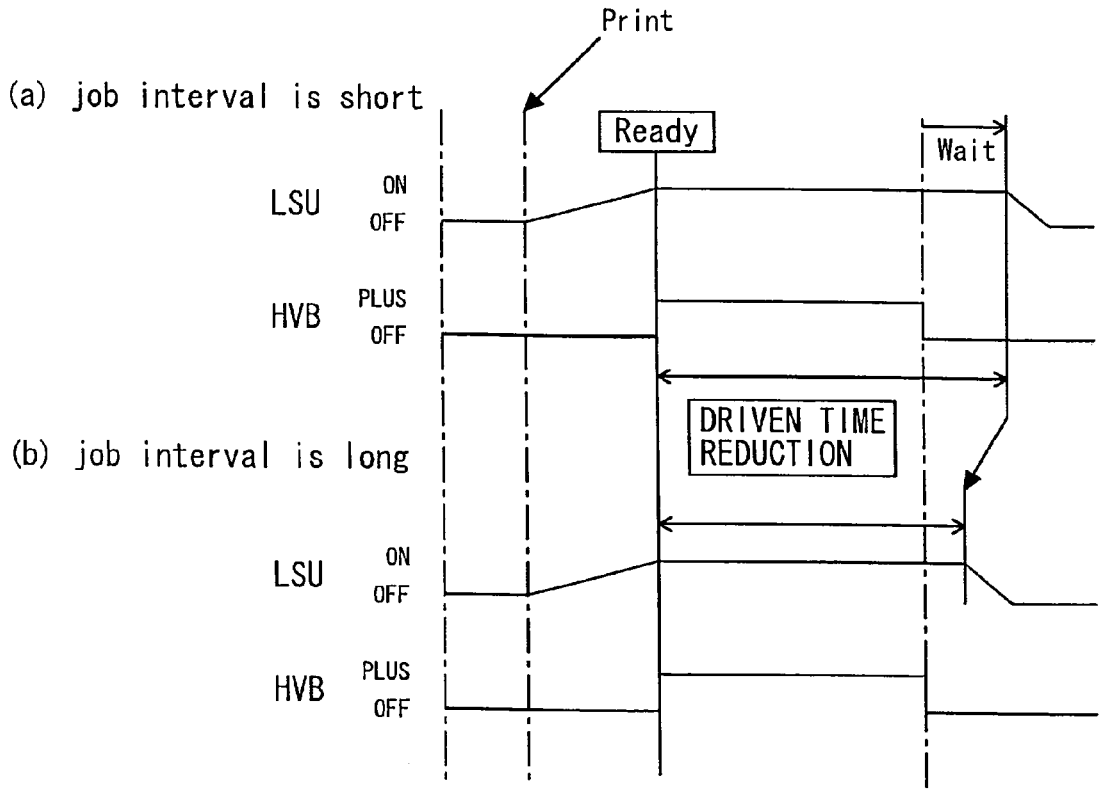
FIG. 13 shows waveforms for describing lengthening of durability of the polygon motor according to another embodiment of the present invention.

Furthermore, each time when a print job has been completed, the time until the next print job can be measured and stored in a storage unit of the controller 12. Then, an average value of several measurements can be calculated. In accordance with the average value, the time of the timer T1 can be set automatically. That is, as shown in FIG. 13(*a*), when the job interval is short, the period T1 can be set relatively long to be prepared for the next print job. As shown in FIG. 13(*b*), when the job interval is long, by setting the period T1, the total driving time of the polygon motor can be reduced and the durability of the polygon motor can be lengthened.

At step ST21*c*, a control to stop the fan starts. At time t2, the timers T4 (exhaust fan stop timer) and T5 (air intake fan stop timer) start. When a timer T4 expires, the exhaust fan 43 stops. When a timer T5 expires, the air intake fan 44 stops. As described above, in the image forming device of the present embodiment, the temperature of the fuser is used as a trigger for starting the driving of the fans 43 and 44. The expiration of the timers T4 and T5 that begin counting from the time the main motor 41 stops, are used as a trigger for stopping the driving operation.

As described above, when the driving starts, the fans 43 and 44 are controlled in accordance with the temperature, and when driving the stops, the fans 43 and 44 are controlled in accordance with the timers. Accordingly, the temperature of the fuser is decreased slowly and the FCOT can be reduced. Further, the FCOT is a period of time required from the reception of a print request at the standby mode until a discharge of a first sheet of printing papers.

Next, at step ST22, a determination is made as to whether or not a timer Tsleep (sleep-in timer) has expired. The timer Tsleep starts from the stop time t2 of the main motor 41. At the expiration of the timer Tsleep, the control mode is switched to a sleep mode. Under the sleep mode, the voltage control, the motor control, the fan control and the heater control are all stopped.

Meanwhile, when the timer Tsleep has not expired yet, the process proceeds to step ST23. At step ST23, a determination is made as to whether or not there is a print request, in other words, whether or not there is a print signal. When there is no print signal, the process returns to step ST22 and the above-described process is executed. Meanwhile, when there is a print signal, the control mode is switched to a printing process mode.

Figure 7:
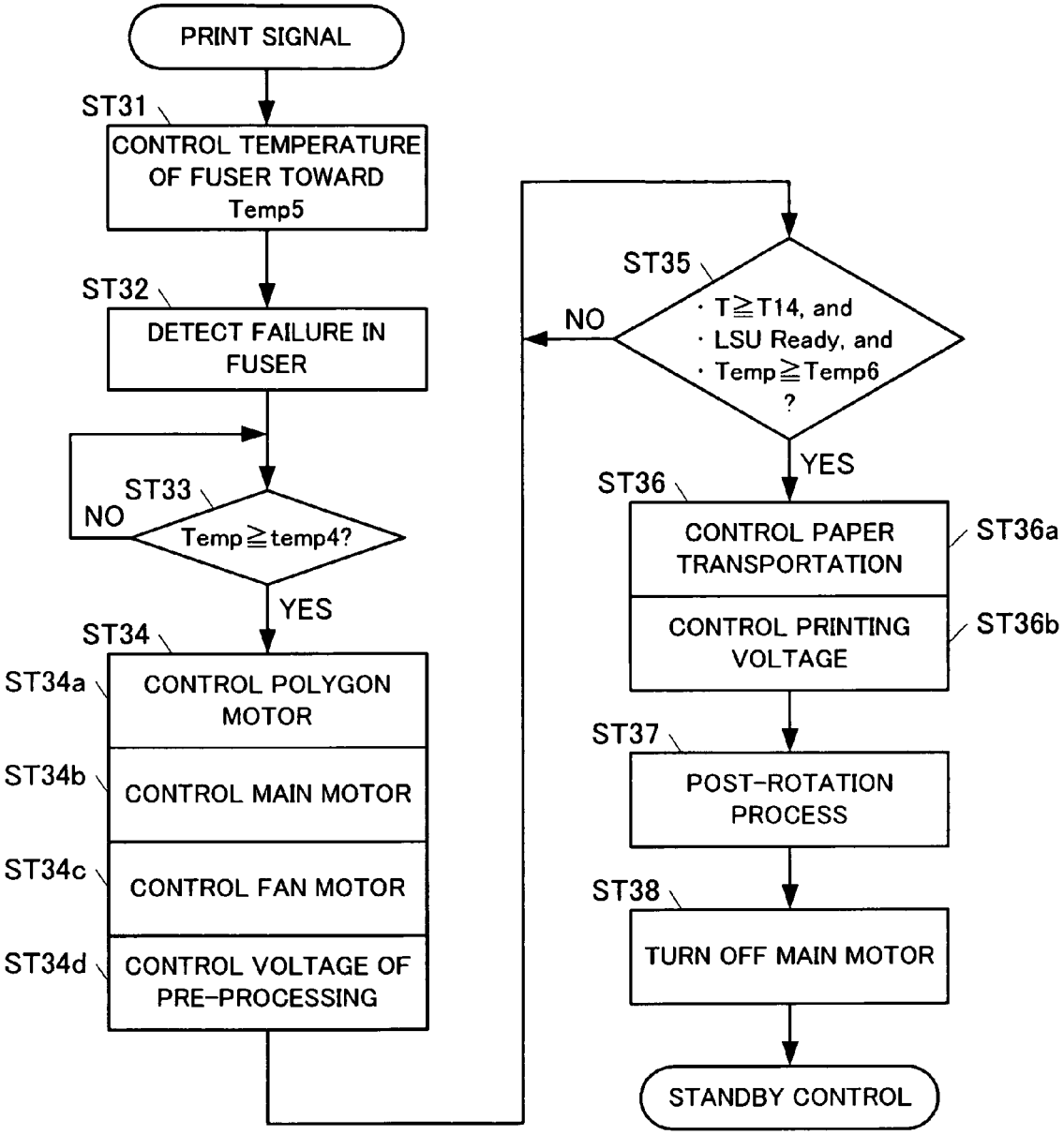
FIG. 7 is a flowchart showing an operation carried out during a printing process.

Next, with reference to the flowchart of FIG. 7 and the time chart of FIG. 8, a description will be made of the printing process mode, especially an operation when printing out only one sheet.

During the standby mode control, when there is a print signal requesting to print one sheet (time t3), at step ST31, a control starts to raise the temperature of the fuser towards a fixing temperature Temp5 (as an example, 190° C.). Next, at step ST32, a process task for monitoring an abnormality in the fuser, in other words, a process task for monitoring whether or not the temperature of the fuser is rising normally starts. This monitoring process task is executed in parallel with the printing process task shown in the flowchart of FIG. 7. Further, when the rise in the temperature of the fuser is determined to be abnormal in the monitoring process task, the printing process task of FIG. 7 is interrupted.

Then, the process proceeds to step ST33 and a determination is made as to whether or not the temperature of the fuser has reached Temp4 (as an example, 170° C.). When the temperature of the fuser reaches Temp4 (time t4), the process proceeds to step ST34.

At step ST34*a*, the polygon motor of the LSU 24 is turned on and the rotation of the polygon motor starts. At time t4, the main motor 41 is turned on, and the photoconductive drum 21, the transfer roller 29, the developing roller 26, the supply roller 25 and the rotating brush 35 start rotating and a timer T14 starts.

The timer T14 is provided for maintaining a paper feed clutch PFCL under a connected state. Further, the paper feed clutch PFCL connects and disconnects a transfer of the driving from the main motor 41 to the pick-up roller 36. In detail, the image forming device of the present embodiment connects the paper feed clutch PFCL and starts to supply the paper P from the paper supply cassette 80 when conditions (5) and (6) are satisfied. Condition (5) is that the Ready signal from the LSU 24 is output. Condition (6) is that the temperature of the fuser has reached Temp6 (as an example, 185° C.), a temperature for starting to supply paper. However, if the supplied paper P arrives at the transferring nip part before the completion of the process carried out during an effective period of the timer T42 (process to return properly charged toner remaining on the transfer roller 29 back to the photoconductive drum 21), there is a possibility for the remaining toner to adhere to a back side of the paper.

Therefore, until an expiration of the timer T14 that expires after the timer T42 has expired, it is necessary to disconnect the paper feed clutch PFCL so that the supply of the paper has not started. Accordingly, in the image forming device of the present embodiment, the paper is supplied from the paper supply cassette 80 when three conditions are satisfied, i.e., conditions (5) and (6) and condition (7) that the timer T14 has expired.

Moreover, at time t4, the control of the fan also starts (step ST34*c*). When the temperature of the fuser reaches Tempf1, the driving of the exhaust fan 43 starts. When the temperature of the fuser reaches Tempf2, the driving of the air intake fan 44 also starts.

At step ST34*d*, a voltage control of the pre-processing of the printing process starts. To describe the voltage control of the pre-processing in detail, at time t4 when the temperature of the fuser reaches Temp4, the charging voltage impressing circuit 23 impresses a positive charging voltage to the scorotron charger 22 and the surface of the photoconductive drum 21 is charged uniformly. At time t4, the timer T31, the timer T32, the timer T41 and the timer T61 start.

At the time when the timer T31 has expired, as the developing voltage HVB, a step voltage (as an example, approximately +10V) of a polarity (positive) that is the same and lower than the developing voltage impressed at the developing process is impressed over a period of time until at least the timer T32 expires. This is for improving the efficiency of collecting the toner. The timers T31 and T32 mentioned here are provided for the same purpose as the timers T31 and T32 shown in the time chart of FIG. 5.

When conditions (8) and (9) are satisfied, the image forming device of the present embodiment switches from the developing voltage HVB to a positive strong voltage (for example, approximately +400V) that is necessary for the developing process. Condition (8) is that the timer T32 has expired. Condition (9) is that the timer T34, counted from the time when the Ready signal was output, has expired. While the positive strong voltage is impressed as the developing voltage HVB, the electrostatic latent image on the photoconductive drum 21 is developed as the toner image.

At the time when the timer T41 has expired, the field of the photoconductive drum 21 charged at time t4 reaches the transferring nip part. At this time, during the effective period of the timer T42, as the transferring voltage HVT, a positive voltage of polarity that is opposite to that of the transfer process is impressed. Accordingly, the remaining toner adhered on the transfer roller 29 is returned to the photoconductive drum 21. The timers T41 and T42 mentioned here are provided for achieving the same function and effect as the timers T41 and T42 shown in the time chart of FIG. 5.

When the timer T42 expires, as the transferring voltage HVT, a weak test voltage (for example, approximately −1 kV) of a polarity that is the same as that of the transfer process is impressed. While the test voltage is impressed to the transfer roller 29, an electric current value flowing into the transfer roller 29 is detected, a prescribed table is referenced and a transferring voltage value corresponding to the detected electric current value is decided. The decided transferring voltage value is the optimum transferring voltage value for transferring the toner image onto paper under temperature and humidity condition of where the image forming device is provided. The decided transferring voltage value is also the voltage value impressed to the transfer roller 29 at step ST36*b* to be described later.

The timer T61 starts at time t4, and at the time when the timer T61 expires, a positive diffusing voltage HVCL is impressed to the rotating brush 35 and the adherence of the toner remaining on the photoconductive drum 21 is weakened to facilitate the remaining toner to be collected at the developing roller 26. The timer T61 mentioned here is provided for achieving the same function and effect as the timer T61 shown in FIG. 5.

Next, the process proceeds to step ST35 and when the above-described conditions (5), (6) and (7) are satisfied at the same time (time t5), the process proceeds to step ST36 and a paper transportation control starts (step ST36*a*). To describe the paper transportation control in detail, during an effective period of a timer Tc1 that started from time t5, when the paper feed clutch PFCL is connected, a paper P is supplied from the paper supply cassette 80 towards the paper transportation path F by the pick-up roller 36. The supplied paper P is eventually detected by the PSS 37, and the two timers T2 and T16 start at a rise time of the output of the PSS 37.

At a time when a timer T2 has expired, the LSU 24 forms an electrostatic latent image on the surface of the photoconductive drum 21. Then, at a time when a timer T16 has expired, a resist clutch REGCL is connected, and the resist rollers 38 sandwich the paper P and transport the paper P towards the transferring nip part. Further, the resist clutch REGCL connects and disconnects a transfer of the driving from the main motor 41 to the resist rollers 38. The rotation of the resist rollers 38 stops until the timer T16 expires. A leading edge of the paper P supplied by the pick-up roller 36 is adjusted by the stopped resist rollers 38 and a skew of the paper P is corrected.

The paper P transported by the resist rollers 38 is eventually sandwiched by the transferring nip part. The toner image on the photoconductive drum 21 is transferred onto the paper at the transferring nip part, and the transferred toner image is fixed by the fuser. The paper that left the fuser is eventually detected by the PDS 39. At the rise time of the output of the PDS 39, in other words, at the time when the leading edge of the paper P that left the fuser is detected by the PDS 39, a positive voltage is impressed to the sub motor 42. Then, the paper discharge rollers 91 are rotated in a paper discharging direction and the discharge of the paper becomes possible. When the paper continues to be transported, a rear edge of the paper P is displaced from a position where the PSS 37 is provided along the paper transportation path F, and the output of the PSS 37 falls. At the fall time of the output of the PSS 37, a timer T17 starts. At the time when the timer T17 has expired, the resist clutch REGCL is disconnected and the rotation of the resist rollers 38 stops. The timer T17 is set at a time required for the rear edge of the paper P to depart from the position of the PSS 37 and to reach the position of the resist rollers 38.

When the paper P continues to be transported, the rear edge of the paper P is displaced from the position where the PDS 39 is located along the paper transportation path F, and the output of the PDS 39 falls. At the fall time of the output of the PDS 39, a timer T105 starts. At the time when the timer T105 expires, the sub motor 42 is turned off and the rotation of the paper discharge rollers 91 in the paper discharging direction stops. The timer T105 is set at a time sufficient for the rear edge of the paper P located at the PDS sensor 38 to be discharged to the outside of the device.

In parallel with the paper transportation control of step ST36*a*, the voltage control for printing starts from time t5 (step ST36*b*). A timer T45 starts at the time when the resist clutch REGCL is connected. At the time when the timer T45 expires, the leading edge of the paper P reaches the transferring nip part. At this time, as the transferring voltage HVT, a voltage that is a negative strong voltage is impressed. The negative higher voltage is for transferring the toner image on the photoconductive drum 21 onto the paper P and decided in the above-described impressing process of the test voltage.

At time t5 and after, the charging voltage impressing circuit 23 impresses a positive charging voltage HVC to the scorotron charger 22, the developing voltage impressing circuit 28 impresses a positive strong voltage to the developer including the developing roller 26, and a positive diffusing voltage HVCL is impressed to the rotating brush 35. Therefore, on the surface of the photoconductive drum 21 charged uniformly by the scorotron charger 22, an electrostatic latent image is formed by the LSU 24 and the electrostatic latent image is developed by the toner supplied from the developing roller 26. At the transferring nip part, the toner image is transferred onto a paper by the transfer roller 29 impressed with a negative strong voltage. The adherence of the toner remaining on the surface of the photoconductive drum 21 after the transfer process is weakened by the rotating brush 35 impressed with the diffusing voltage HVCL, and the toner is collected again by the developing roller 26.

After the above-described transfer process, the process proceeds to step ST37. By switching the transferring voltage HVT in accordance with various timers, a cleaning process (post-rotation process) is executed on the transfer roller 29 and the photoconductive drum 21.

To describe the post-rotation process, the timers T46 and T47 start at the rise time of the PSS 37. At a time when a timer T46 expires, the rear edge of the paper P passes through the transferring nip part and the transfer process of the toner image onto the paper P is completed. At the time when the timer T46 expires, the transferring voltage impressing circuit 30 impresses a negative weak voltage (for example, approximately −400V) to the transfer roller 29 until a timer T47 expires.

Then, at the time when the timer T47 expires, the timer T48 starts, and the transferring voltage HVT is switched off until the timer T48 expires. During an effective period of a timer T49, as the transferring voltage HVT, a positive strong voltage (for example, approximately +1 kV) of a polarity that is opposite to that of the transfer process is impressed. While the positive strong voltage is impressed, the properly charged toner remaining on the transfer roller 29 is returned onto the photoconductive drum 21 and a cleaning process of the transfer roller 29 is carried out. Moreover, at the expiration of the timer T49, the transferring voltage HVT is switched off and a timer T12 starts.

A time counted by a timer T49 is set longer than the time required for the transfer roller 29 to make one rotation. Therefore, the transfer roller 29 is cleaned for the entire periphery. Moreover, after the negative strong voltage required for the transfer process is impressed, until the positive strong voltage required for the cleaning process is impressed, there are two stages of voltage changing steps. One of the stages is an impressing period of the negative weak voltage (period of time from the expiration of the timer T46 until the expiration of the timer T47) and the other stage is a non-impressing period (timer T48). This is for preventing the remaining toner from scattering or a drastic load from being placed on the transfer roller 29 that results when the electric potential is switched suddenly.

At the time when the timer T48 expires, a timer T33 starts. At the time when the timer T33 expires, the field of the photoconductive drum 21, located at the transferring nip part after the timer T49 has expired, reaches the developing nip part. At this time, the developing voltage impressing circuit 28 switches the developing voltage HVB to a positive weak voltage for improving the efficiency of collecting the toner remaining on the surface of the photoconductive drum 21.

When the timer T12 expires, the rotation of the main motor 42 stops, and the voltages impressed to the scorotron charger 22, the developing roller 26 and the rotating brush 35 are switched off Then, the control mode is switched to the above-described standby mode. Since the expiration time of the timer T12 is set at a later time than the expiration time of the timer T105, the main motor 41 and the sub motor 42 do not stop at the same time.

Further, the period of time from the expiration time of the timer T33 until the expiration time of the timer T12, in other words, the period of time when a positive weak voltage is impressed as the developing voltage HVB, is set longer than the period of time required for the photoconductive drum 21 to make one rotation. Accordingly, the electric potential of the surface of the photoconductive drum 21 is stabilized for the entire periphery after the toner collecting process.

Figure 9:
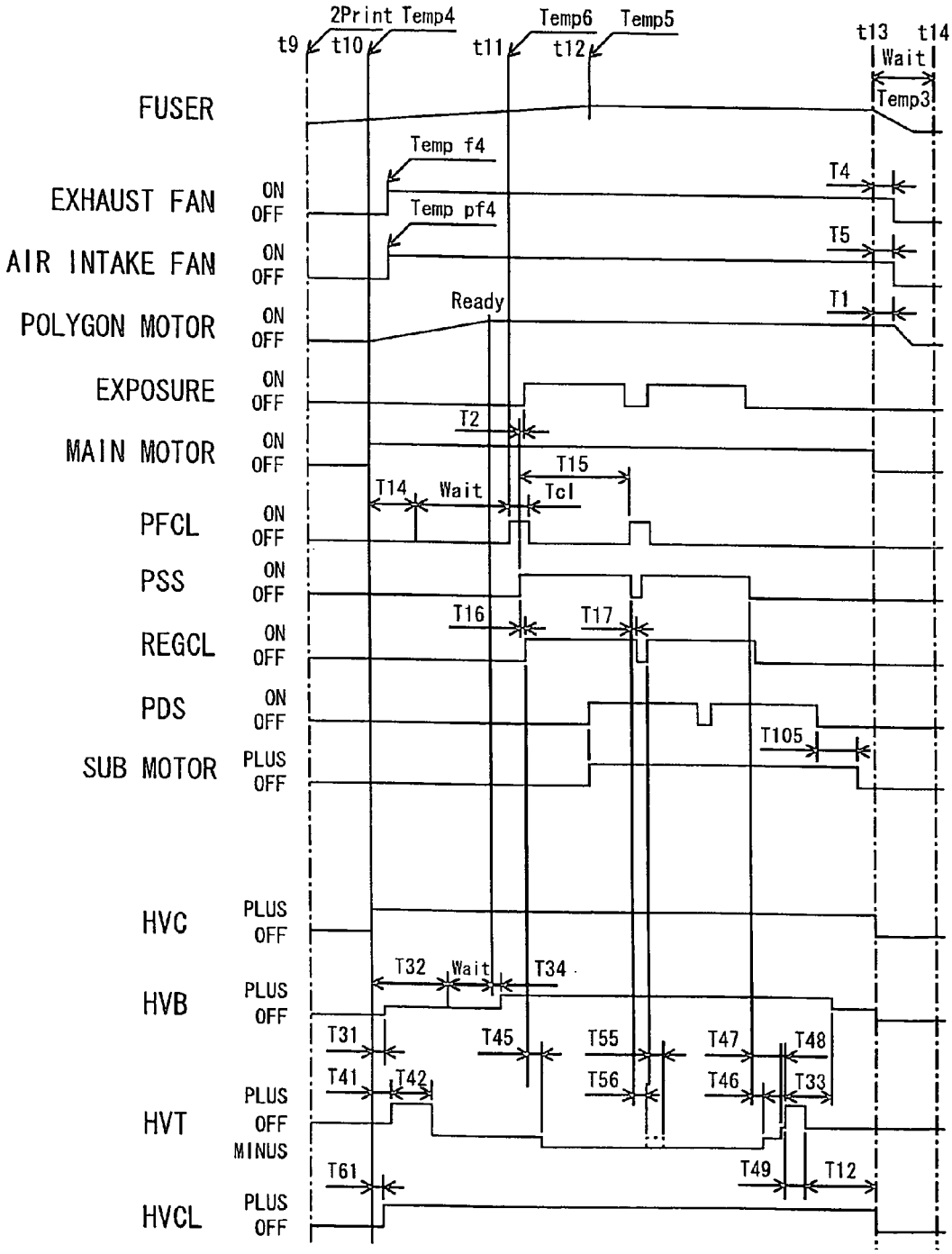
FIG. 9 is a time chart showing waveforms when printing two sheets consecutively.

Next, referring to the flowchart of FIG. 7 and the time chart of FIG. 9, a description will be made to an operation for consecutively printing onto two sheets of papers or more. In the consecutive printing process, only the paper transportation control of step ST36*a* and the printing voltage control of step ST36*b* differ from the control carried out when printing onto one sheet of paper. Therefore, referring to FIG. 9, a description will be made to only the parts that are different.

To describe the paper transportation control in case of consecutive printing, during an effective period of a timer Tc1 starting from time t11 when the temperature of the fuser has reached Temp6, the paper feed clutch PFCL is connected, and a first sheet of papers P is supplied from the paper supply cassette 80 towards the paper transportation path F by the pick-up roller 36. When the first sheet of the papers P is supplied, as in the control of FIG. 8, after the timer T16 elapses from the rise time of the PSS 37, the resist clutch REGCL is connected and the first sheet of the papers P is transported to the transferring nip part. At the time when the output of the PDS 39 rises, a positive voltage is impressed to the sub motor 42 and the paper discharge roller rotates in the paper discharging direction. Then, after the timer T17 elapses from the fall time of the output of the PSS 37, the resist clutch REGCL is disconnected.

In the paper transportation control carried out in the consecutive printing process, a timer T15 starts each time when the paper feed clutch PFCL is connected. The timer T15 is used for supplying a second sheet of the papers and all sheets afterwards. When the timer T15 expires, the paper feed clutch PFCL is connected again during the period of the timer Tcl, and the second sheet of the papers P and all sheets afterwards are supplied from the paper supply cassette 80 towards the paper transportation path F.

For the transportation control of the second sheet of the papers, also as in the transportation control of the first sheet of the papers, after the timer T16 elapses from the rise time of the output of the PSS 37, the resist clutch REGCL is connected and the paper is transported to the transferring nip part. After the timer T17 elapses from the fall time of the PSS 37, the resist clutch REGCL is disconnected. As described above, the papers are supplied consecutively from the paper supply cassette 80.

At the time when the rear edge of a last sheet of the papers P is detected by the PDS 39, the timer T105 starts, and at the time when the timer T105 expires, the sub motor 41 is turned off.

Next, a description will be made of the printing voltage control in the consecutive printing operation. After the timer T45 elapses from the time when the resist clutch is connected at first, the leading edge of the first sheet of the papers arrives at the transferring nip part. At this time, the transferring voltage HVT, a negative strong voltage (for example, approximately −1.0 kV) is impressed to the transfer roller 29 and a toner image is transferred onto the first sheet of the papers P.

Then, at the time when the rear edge of the first sheet of the papers is detected by the PSS 37, in other words, after an elapse of a timer T56 after the output of the PSS 37 falls, the transferring voltage HVT is switched to a negative weak voltage (for example, approximately −400V). In parallel with this, when a timer T55 elapses from the time when the resist clutch RGCL is connected for transporting the second sheet of the papers to the transferring nip part, the transferring voltage HVT is switched to a negative strong voltage for transferring the toner image and the toner image is transferred onto the second sheet of the papers P.

During a period between the transfer process of the first sheet of the papers P and the transfer process of the second sheet of the papers P, in other words, during a period when paper is not sandwiched in the transferring nip part, by switching the transferring voltage HVT to a weak voltage, a force of the transfer roller 29 to attract the toner from the surface of the photoconductive drum 21 becomes weak during this period. As a result, the transfer roller 29 can be prevented from being contaminated. Then, after the transfer process of the toner image onto the last sheet of the papers in the consecutive printing has been completed, in other words, after the rear edge of the last sheet of the papers is detected by the PSS 37, the post-rotation process described in FIG. 8 is carried out.

Figure 8:
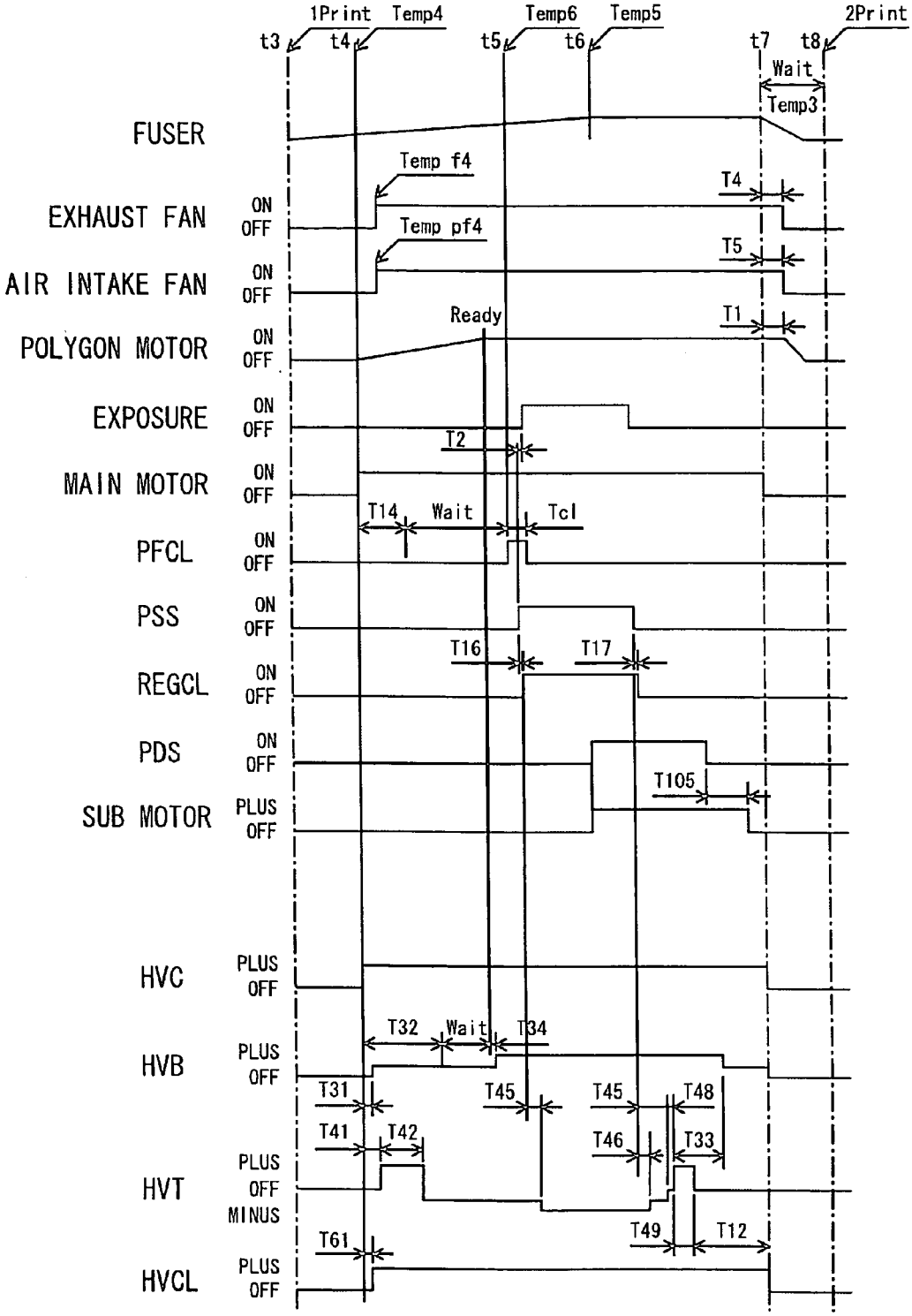
FIG. 8 is a time chart showing waveforms of each unit when printing one sheet.

The main purpose of the post-rotation process of FIG. 8 is to carry out a cleaning process of the transfer roller 29 by returning the toner remaining on the transfer roller 29 to the photoconductive drum 21. When the printing job has been carried out for several times, a large amount of toner is eventually trapped by the rotating brush 35. If a large amount of toner is trapped, the original function of the rotating brush 35 decreases. Therefore, it is necessary to carry out the cleaning process of the rotating brush 35 when appropriate. Thus, in the image forming device of the present embodiment, under an appropriate rate, for example, under a rate of once per ten printing jobs, a cleaning process of the diffusing unit is carried out instead of the post-rotation process of FIG. 8.

Figure 10:
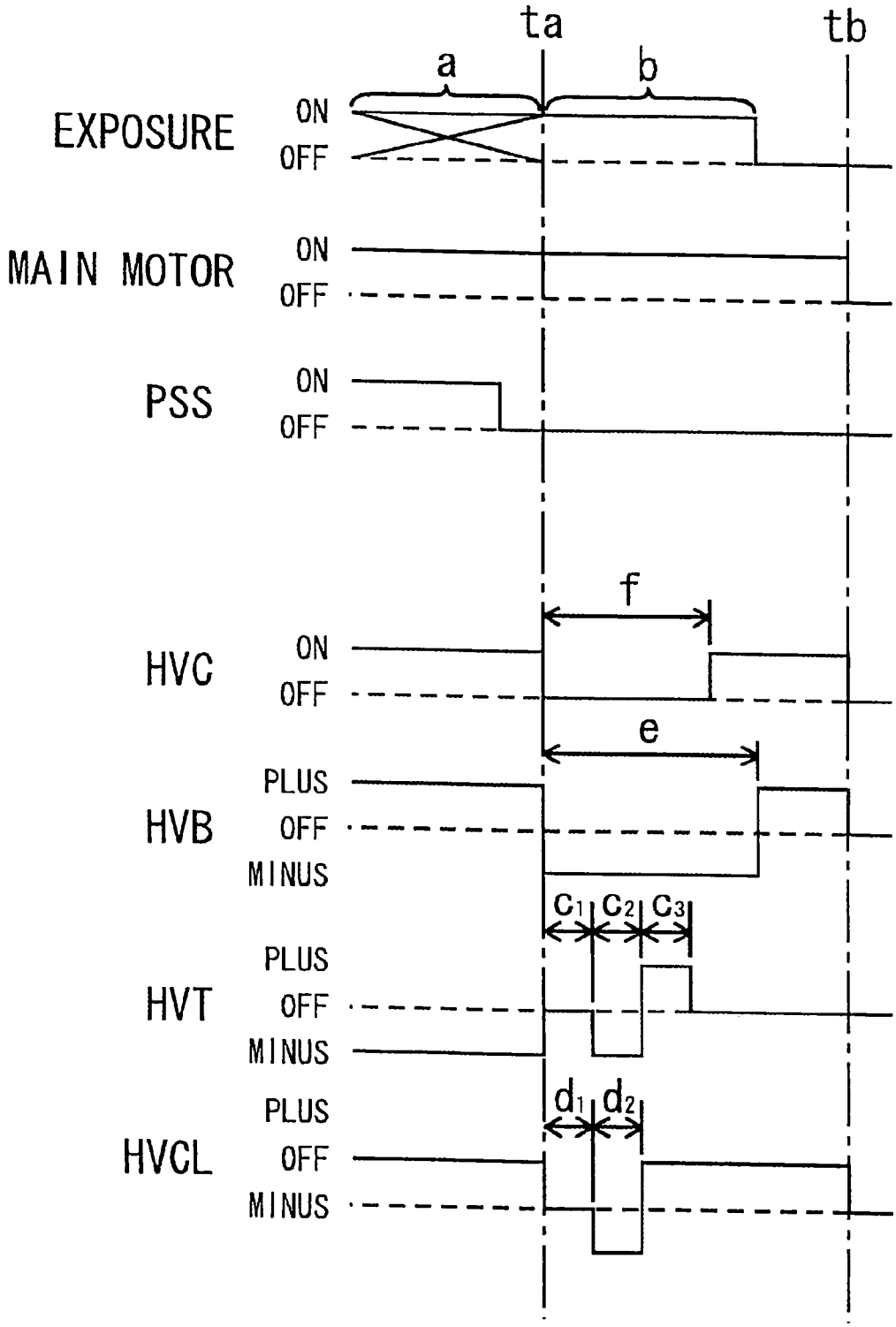
FIG. 10 is a time chart showing waveforms of each unit during a cleaning process of a diffusing unit.

FIG. 10 is a time chart of the waveforms of the cleaning process of the diffusing unit. Referring to FIG. 10, during a period (a) from the fall time of the output of the PSS 37 until time ta when the rear edge of the paper passes through the transferring nip, in other words, during a transfer process executing period (a), a positive strong voltage is impressed as the charging voltage HVC and the surface of the photoconductive drum 21 is charged uniformly. In addition, an electrostatic latent image is formed on the surface of the photoconductive drum 21 by the LSU 24. A positive strong voltage is impressed as the developing voltage HVB and an electrostatic latent image is developed. A negative strong voltage is impressed as the transferring voltage HVT and the toner image is transferred onto the paper. A positive voltage is impressed as the diffusing voltage HVCL and the toner remaining on the surface of the photoconductive drum 21 after the transfer process is diffused and trapped.

Next, a description will be made to the control of the voltage impressing circuits 23, 28, 30 and 35*a* and the LSU 24 in the cleaning process of the diffusing unit. At the time when the output of the PSS 37 falls, in other words, at the time ta which is after the time corresponding to the expiration time of the timer T46 in FIG. 8, and at the time ta that corresponds to the start time of the timer T47, the charging voltage HVC is switched off and the switched off state is maintained during an effective period of a timer (f). Then, the charging voltage HVC is switched on, and at time tb when the main motor 41 is turned off, the charging voltage HVC is switched off.

During an effective period of a timer (b) that starts from the time ta, the LSU 24 exposes the entire surface of the photoconductive drum 21. Moreover, at the time ta, as the developing voltage HVB, a voltage of polarity that is the opposite to that of the developing process is impressed during an effective period of a timer (e). Then, a positive strong voltage is impressed as the developing voltage HVB, and the developing voltage HVB is switched off at the time tb.

During an effective period of a timer c1 that starts from the time ta, the transferring voltage HVT is switched off. Then, during an effective period of a timer c2, a negative strong voltage is impressed. During an effective period of a timer c3, a positive strong voltage is impressed and then switched off.

During an effective period of a timer d1 that starts from the time ta, the diffusing voltage HVCL is switched off. During an effective period of a timer d2, as the diffusing voltage HVCL, a negative strong voltage of polarity that is the opposite to that of the printing process is impressed. Then, at the time tb when the main motor 41 is turned off, the diffusing voltage HVCL is switched off.

A description will be made to the cleaning process of the diffusing unit. By switching off the transferring voltage HVT during the effective period of the timer c1, the toner remaining on the surface of the photoconductive drum 21 is prevented from moving onto the transfer roller 29 while there is no paper at the transferring nip part. Then, the transferring voltage HVT is switched to a polarity (negative) that is the opposite to the charging polarity (positive) of the toner, and the switched transferring voltage is impressed during the effective period of the timer c2. The transferring voltage HVT impressed during the timer c2 is a voltage for generating an electric field that is strong enough for charging the surface of the photoconductive drum 21. Therefore, a part of the photoconductive drum 21 that passed the transferring nip part during the effective period of the timer c2 is charged and an electric charge is held on the surface of the photoconductive drum 21.

At a time when the part that passed the transferring nip part at the start time of the timer c2 arrives at a contact part of the photoconductive drum 21 and the rotating brush 35, in other words, at the time when the timer d1 expires, a negative strong voltage is impressed as the diffusing voltage HVCL. During the effective period of the timer d2, the toner trapped by the rotating brush 35 at the printing process is discharged towards the photoconductive drum 21. Furthermore, when the electrically charged field of the photoconductive drum 21 passes the contact part, the toner discharged from the rotating brush 35 is attracted to the photoconductive drum 21. The rotating brush 35 is cleaned in the above-described manner.

The cleaning process of the rotating brush 35 is preferable to be carried out for the entire periphery of the rotating brush 35. Therefore, in the present embodiment, the effective period of the timer c2 is set so that a distance in which the surface of the photoconductive drum 21 moves during the effective period of the timer c2 becomes longer than the entire periphery of the rotating brush 35. In addition, for the same reason, the effective period of the timer d2 is set longer than the time required for the rotating brush 35 to make one rotation.

Furthermore, during the effective period of the timer c3, the transferring voltage HVT of a polarity (positive) that is the opposite to the polarity (negative) impressed during the effective period of the timer c2 is impressed. Therefore, during the effective period of the timer c2, the toner that moved from the photoconductive drum 21 to the transfer roller 29 is returned again to the photoconductive drum 21 and collected by the developing roller 26.

The process carried out during the effective period of the timer (b) and the process carried out during the effective period of the timer (f) are carried out for weakening the adherence of the toner discharged from the rotating brush 35 and adhered on the photoconductive drum 21. The process carried out during the effective period of the timer (e) is carried out for reliably collecting the properly charged toner adhered on the photoconductive drum 21 by the negative voltage of the developing roller 26.

In the present embodiment, the rotating brush 35 comes into contact with the photoconductive drum 21 while rotating was described as the diffusing unit. However, instead of the rotating brush 35, a diffusing brush that maintains contact within a prescribed width in the moving direction of the photoconductive drum 21 can be used. In this case, it is preferable to clean the entire width of the diffusing brush. Therefore, the time of the timer c2 is preferable to be set so that the distance in which the surface of the photoconductive drum 21 moves during the effective period of the timer c2 becomes longer than the entire width of the diffusing brush 35.

Figure 11:
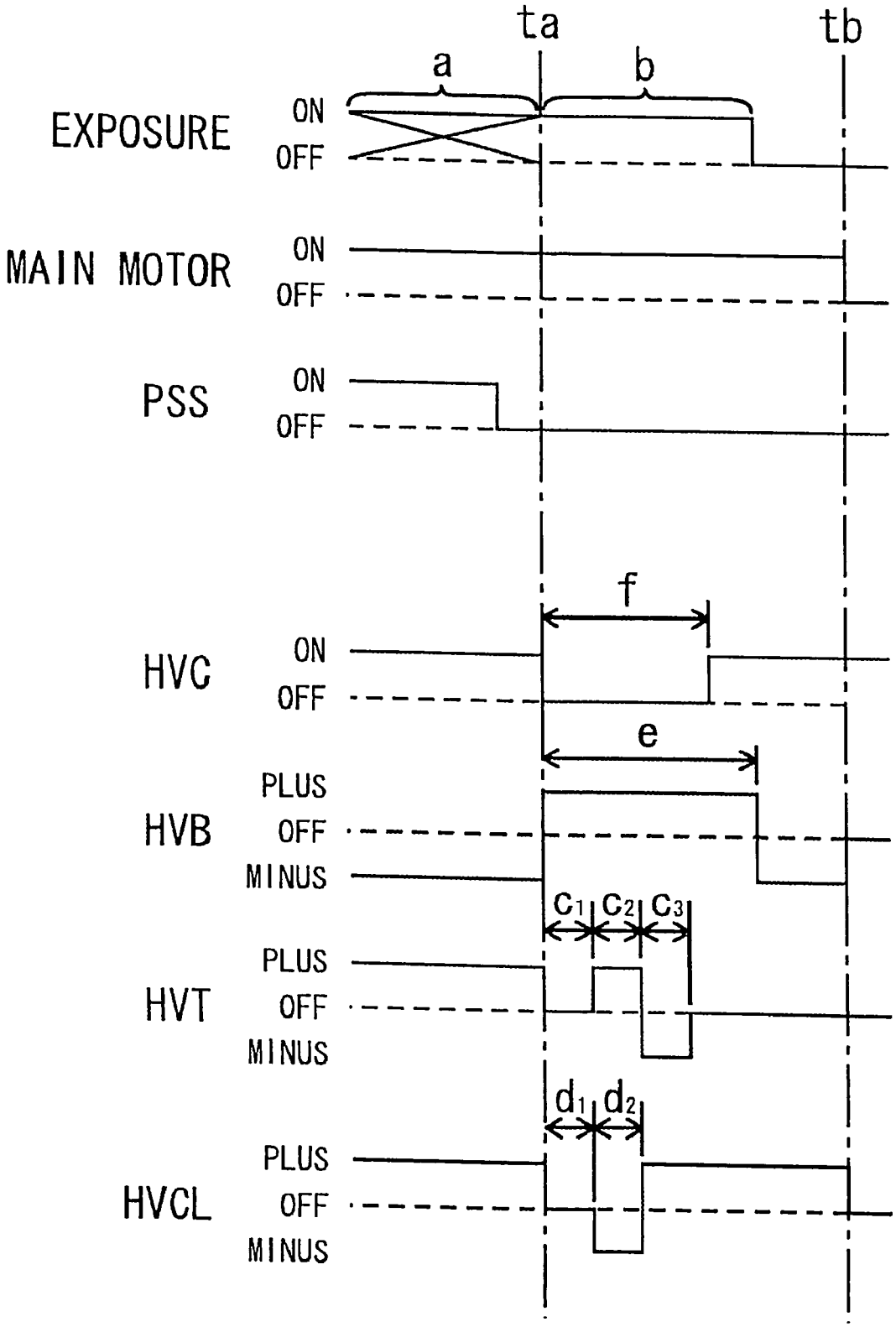
FIG. 11 is a time chart showing waveforms of each unit during the cleaning process of the diffusing unit in another example.

When carrying out the cleaning process of the diffusing unit in case of the negatively charged toner, as shown in FIG. 11, by impressing the developing voltage HVB, the transferring voltage HVT and the diffusing voltage HVCL of a polarity that is the opposite to that of the example shown in FIG. 10, the cleaning process can be executed in the same manner.

Moreover, when using the negatively charged toner, even if the voltage impressed to the rotating brush 35 is switched off during the period d1, is negative during the period d2, and is positive during other periods in FIG. 10, the above-described cleaning process of the diffusing unit can be carried out. When using the positively charged toner, even if the voltage impressed to the rotating brush 35 is switched off during the period d1, is positive during the period d2, and is negative during other periods in FIG. 10, a preferable cleaning process of the diffusing unit can be carried out in the same manner.

What is claimed is:

1. An image forming device comprising:

means for forming an image comprising:

means for carrying an electrostatic latent image;

means for developing that forms a developing nip by contacting with the means for carrying and develops the latent image by using toner; and means for transferring that forms a transferring nip by contacting the means for carrying and transfers a toner image onto a recording paper;

means for impressing a transferring voltage that impresses to the means for transferring, a voltage of an opposite polarity to a polarity of a transfer process, for a prescribed period of time during a period when the recording paper is absent in the transferring nip; and means for impressing a developing voltage that impresses to the means for developing, a voltage of a same polarity as a developing process and lower than the developing process when a field impressed with the voltage of the opposite polarity by the means for impressing the transferring voltage passes the developing nip.

2. The image forming device according to claim 1, wherein the means for carrying stops rotating after making at least one rotation after a field located at the transferring nip when the voltage impressed to the means for transferring is switched off reaches the developing nip.

3. The image forming device according to claim 1, further comprising:

means for scanning by laser that includes a polygon motor and forms the electrostatic latent image by irradiating laser light on the means for carrying; and means for controlling to rotate the polygon motor at a prescribed rotational speed for a predetermined period of time even after the means for forming the image stops.

4. The image forming device according to claim 3, wherein the means for forming the image is stopped by stopping the means for carrying.

5. The image forming device according to claim 3, wherein the means for forming the image is stopped by stopping means for transporting the recording paper.

6. The image forming device according to claim 3, wherein the predetermined period of time can be set.

7. The image forming device according to claim 6, further comprising:

means for clocking a time from an end of a previous driving of the means for forming the image until a start of a next driving of the means for forming the image;

means for accumulating and storing clocking results of the means for clocking; and means for setting the predetermined period of time in accordance with one or a plurality of the clocking results stored in the means for storing.

8. The image forming device according to claim 1, further comprising:

a first means for driving the means for forming the image;

means for transporting the recording paper;

a second means for driving at least a part of the means for transporting; and means for controlling to differ timings of a start of driving of the first means for driving and a start of driving of the second means for driving.

9. The image forming device according to claim 8, wherein the means for controlling starts to drive the second means for driving after the first means for driving starts driving.

10. The image forming device according to claim 1, further comprising:

a first means for driving the means for forming the image;

means for transporting the recording paper;

a second means for driving at least a part of the means for transporting; and means for controlling to differ timings of a stop of driving of the first means for driving and a stop of driving of the second means for driving.

11. The image forming device according to claim 10, wherein the means for controlling stops the driving of the second means for driving before the first means for driving stops driving.

12. The image forming device according to claim 1, further comprising:

a first means for driving that rotates the means for carrying and the means for transferring;

means for scanning by laser that includes a polygon motor and a second means for driving that rotates the polygon motor;

a first means for controlling that starts driving of the first means for driving and the second means for driving at a same time; and a second means for controlling that executes a cleaning sequence process to return toner adhered on the means for transferring back to the means for carrying during a period from a start of the driving of the second means for driving until a print permitting signal is output by the means for scanning.

13. The image forming device according to claim 12, wherein the cleaning sequence process includes at least one of a process for impressing to the means for transferring, the voltage of the opposite polarity of an image forming process, and a process for impressing to the means for transferring, the voltage of the same polarity.

14. The image forming device according to claim 12, wherein the cleaning sequence process includes at least one of a process for impressing to the means for developing, the voltage of the same polarity and lower than an image forming process, and a process for not impressing a voltage.

15. The image forming device according to claim 12, wherein the means for forming the image includes means for diffusing toner adhered on the means for carrying, and the cleaning sequence process includes one of a process for impressing to the means for diffusing, the voltage of the opposite polarity of an image forming process, and a process for impressing to the means for diffusing, the voltage of the same polarity.

16. The image forming device according to claim 12, wherein the means for forming the image includes means for uniformly charging the means for carrying, and the cleaning sequence process includes a process for impressing to the means for charging, the voltage of the opposite polarity of an image forming process.

17. The image forming device according to claim 12, wherein the second means for controlling stops the cleaning sequence process when the print permitting signal is not output from the means for scanning even after an elapse of a predetermined period of time.

18. The image forming device according to claim 1, further comprising:

means for detecting environmental condition in the image forming device;

means for cooling that includes at least one of means for taking outside air into the image forming device and means for exhausting air in the image forming device;

means for driving the means for carrying;

a first means for controlling that operates the means for cooling when a condition detected by the means for detecting satisfies a predetermined condition;

means for timing that starts counting when the means for driving stops driving; and a second means for controlling that stops the means for cooling when the means for timing expires.

19. The image forming device according to claim 18, comprising:

means for fixing toner transferred onto paper by heat, wherein the means for detecting detects a temperature of the means for fixing.

20. An image forming method comprising:

impressing to a transfer roller, a voltage of an opposite polarity to a polarity of when a toner image is transferred onto a recording paper, for a prescribed period of time during a period when a recording paper is absent in a transferring nip where a photoconductive drum and the transfer roller are in contact; and impressing to a developing roller, a voltage of a same polarity as when developing an electrostatic latent image by toner and that is lower than a developing process, when a field of the photoconductive drum impressed with the voltage of the opposite polarity by the transfer roller passes a developing nip where the developing roller and the photoconductive drum are in contact.

21. The image forming method according to claim 20, further comprising stopping a rotation of the photoconductive drum after the photoconductive drum makes at least one rotation after a field of the photoconductive drum located at the transferring nip reaches the developing nip, when the voltage impressed to the transfer roller is switched off.

22. The image forming method according to claim 20, further comprising:

forming the electrostatic latent image by irradiating laser light on the photoconductive drum by a laser scanner unit that includes a polygon motor; and rotating the polygon motor under a prescribed rotation speed for a predetermined period of time after an image forming process.

23. The image forming method according to claim 22, further comprising ending the image forming process when the photoconductive drum stops.

24. The image forming method according to claim 22, further comprising ending the image forming process when a recording paper transporting device that transports a recording paper stops.

25. The image forming method according to claim 22, further comprising setting the predetermined period of time.

26. The image forming method according to claim 25, further comprising:

clocking a time from an end of a previous image forming process until a start of a next image forming process;

storing clocking results by accumulating in a memory; and setting the predetermined period of time in accordance with one or a plurality of the clocking results stored in the memory.

27. The image forming method according to claim 20, further comprising differing a start of driving of a main motor for driving the photoconductive drum and a start of driving of a sub motor for driving at least a part of a recording paper transporting device.

28. The image forming method according to claim 27, further comprising starting the driving of the sub motor after starting the driving of the main motor.

29. The image forming method according to claim 20, further comprising differing a stop of driving of a main motor for driving the photoconductive drum and a stop of driving of a sub motor for driving at least a part of a recording paper transporting device.

30. The image forming method according to claim 29, further comprising stopping driving of a second motor before stopping driving of a first motor.

31. The image forming method according to claim 20, further comprising:

starting driving of a polygon motor for rotating a polygon mirror of a laser scanner unit at a same time as when starting driving of a main motor for driving the photoconductive drum and the transfer roller; and executing a cleaning sequence process for returning toner adhered on the transfer roller back to an image carrier during a period from a start of driving of the polygon motor until a print permitting signal is output by the laser scanner unit.

32. The image forming method according to claim 31, further comprising executing to the transfer roller during the cleaning sequence process, at least one of a process for impressing a voltage of an opposite polarity to an image forming process and a process for impressing a voltage of a same polarity.

33. The image forming method according to claim 31, further comprising executing to the developing roller during the cleaning sequence process, at least one of a process for impressing a voltage of a same polarity and lower than an image forming process and a process for not impressing a voltage.

34. The image forming method according to claim 31, further comprising executing to a diffusing brush that diffuses toner adhered on the photoconductive drum during the cleaning sequence process, one of a process for impressing a voltage of an opposite polarity to a polarity of an image forming process and a process for impressing a voltage of a same polarity.

35. The image forming method according to claim 31, further comprising executing to a charger that uniformly charges the photoconductive drum during the cleaning sequence process, a process for impressing a voltage of an opposite polarity to a polarity of an image forming process.

36. The image forming method according to claim 31, further comprising stopping the cleaning sequence process when a print permitting signal is not output from the laser scanner unit even after an elapse of a predetermined period of time.

37. The image forming method according to claim 20, further comprising:

detecting environmental condition in an image forming device;

operating a cooling device that includes at least one of an air intake fan for taking outside air into the image forming device and an exhaust fan for exhausting air in the image forming device, when a detected condition satisfies a predetermined condition;

counting a timer when a main motor for driving the photoconductive drum stops; and stopping the cooling device when the timer expires.

38. The image forming method according to claim 37, wherein the environmental condition in the image forming device is a temperature of a fixing device for fixing toner transferred onto a recording paper by heat.

39. An image forming device comprising:

an image forming unit that includes a photoconductive drum which carries an electrostatic latent image, a developing roller which forms a developing nip by contacting the photoconductive drum and develops the latent image by using toner, and a transfer roller that forms a transferring nip by contacting the photoconductive drum and transfers a toner image onto a recording paper;

a transferring voltage impressing circuit that impresses to the transfer roller, a voltage of an opposite polarity to a polarity of a transfer process, for a prescribed period of time during a period when the recording paper is absent in the transferring nip; and a developing voltage impressing circuit that impresses to the developing roller, a voltage of a same polarity as a developing process and lower than the developing process when a field impressed with the voltage of the opposite polarity by the transferring voltage impressing circuit passes the developing nip.

40. The image forming device according to claim 39, wherein the photoconductive drum stops rotating after making at least one rotation after a field located at the transferring nip when the voltage impressed to the transfer roller is switched off reaches the developing nip.

41. The image forming device according to claim 39, further comprising:

a laser scanner unit that includes a polygon motor and forms an electrostatic latent image by irradiating laser light on the photoconductive drum; and a controller that rotates the polygon motor at a prescribed rotation speed for a predetermined period of time even after the image forming unit stops.

42. The image forming device according to claim 41, wherein the image forming unit stops when the photoconductive drum stops.

43. The image forming device according to claim 41, wherein the image forming unit stops when a recording paper transporting device that transports a recording paper stops.

44. The image forming device according to claim 41, wherein the predetermined period of time can be set.

45. The image forming device according to claim 44, further comprising:

a timer that clocks a time from an end of a previous driving of the image forming unit until a start of a next driving of the image forming unit;

a memory that accumulates and stores clocking results of the timer; and a setting device that sets the predetermined period of time in accordance with one or a plurality of the clocking results stored in the memory.

46. The image forming device according to claim 39, further comprising:

a main motor that drives the image forming unit;

a recording paper transporting device that transports a recording paper;

a sub motor that drives at least a part of the recording paper transporting device; and a controller that differs timings of a start of driving of the main motor and a start of driving of the sub motor.

47. The image forming device according to claim 46, wherein the controller starts to drive the sub motor after the main motor starts driving.

48. The image forming device according to claim 39, further comprising:

a main motor that drives the image forming unit;

a recording paper transporting device that transports a recording paper;

a sub motor that drives at least a part of the recording paper transporting device; and a controller that differs timings of a stop of driving of the main motor and a stop of driving of the sub motor.

49. The image forming device according to claim 48, wherein the controller stops the driving of the sub motor before the main motor stops driving.

50. The image forming device according to claim 39, further comprising:

a main motor that rotates the photoconductive drum and the transfer roller;

a laser scanner unit that includes a polygon mirror and a polygon motor that rotates the polygon mirror;

a first controller that starts driving of the polygon motor and the main motor at a same time; and a second controller that executes a cleaning sequence process to return toner adhered on the transfer roller back to the photoconductive drum during a period of time from the start of the driving of the polygon motor until a print permitting signal is output by the laser scanner unit.

51. The image forming device according to claim 50, wherein the cleaning sequence process includes at least one of a process for impressing to the transfer roller, a voltage of an opposite polarity to a polarity of an image forming process, and a process for impressing to the transfer roller, a voltage of same polarity.

52. The image forming device according to claim 50, wherein the cleaning sequence process includes at least one of a process for impressing to the developing roller, a voltage of a same polarity and lower than an image forming process, and a process for not impressing a voltage.

53. The image forming device according to claim 50, wherein the image forming unit includes a diffusing brush that diffuses toner adhered on the photoconductive drum, and the cleaning sequence process includes one of a process for impressing to the diffusing brush, a voltage of an opposite polarity to a polarity of an image forming process, and a process for impressing to the diffusing brush, a voltage of same polarity.

54. The image forming device according to claim 50, wherein the image forming unit includes a charger that uniformly charges the photoconductive drum, and the cleaning sequence process includes a process for impressing to the charger, a voltage of an opposite polarity to a polarity of an image forming process.

55. The image forming device according to claim 50, wherein the second controller stops the cleaning sequence process when the print permitting signal is not output from the laser scanner unit after an elapse of a predetermined period of time.

56. The image forming device according to claim 39, further comprising:

an environmental condition detecting device that detects an environmental condition in the image forming device;

a cooling device that includes at least one of an air intake fan that takes outside air into the image forming device and an exhaust fan that exhausts air in the image forming device;

a main motor that drives the photoconductive drum;

a first controller that operates the cooling device when a condition detected by the environmental condition detecting device satisfies a predetermined condition;

a timer that starts counting when the main motor stops driving; and a second controller that stops the operation of the cooling device when the timer expires.

57. The image forming device according to claim 56, further comprising:

a fixing device that fixes by heat, toner transferred onto a paper;

wherein the environmental condition detecting device is a temperature detecting sensor that detects a temperature of the fixing device.

* * * * *